US012774846B2

(12) United States Patent
Jung et al.

(10) Patent No.: US 12,774,846 B2
(45) Date of Patent: Oct. 27, 2026

(54) VACUUM ADIABATIC BODY

(71) Applicant: LG ELECTRONICS INC., Seoul (KR)

(72) Inventors: Wonyeong Jung, Seoul (KR); Deokhyun Youn, Seoul (KR); Daewoong Kim, Seoul (KR); Jangseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 276 days.

(21) Appl. No.: 18/034,984

(22) PCT Filed: Nov. 1, 2021

(86) PCT No.: PCT/KR2021/015573
§ 371 (c)(1),
(2) Date: May 2, 2023

(87) PCT Pub. No.: WO2022/092966
PCT Pub. Date: May 5, 2022

(65) Prior Publication Data

US 2024/0019200 A1 Jan. 18, 2024

(30) Foreign Application Priority Data

Nov. 2, 2020 (KR) ..... 10-2020-0144746
Nov. 2, 2020 (KR) ..... 10-2020-0144749

(51) Int. Cl.
*F25D 23/06* (2006.01)
*F25D 23/02* (2006.01)

(52) U.S. Cl.
CPC ..... *F25D 23/065* (2013.01); *F25D 23/02* (2013.01); *F25D 2201/14* (2013.01)

(58) Field of Classification Search
CPC ..... F25D 23/065; F25D 23/02; F25D 2201/14
See application file for complete search history.

(56) References Cited

U.S. PATENT DOCUMENTS 10,639,743 B2 * 5/2020 Azuma ..... B23K 26/21
10,760,849 B2 9/2020 Jung et al.
(Continued)

FOREIGN PATENT DOCUMENTS

CN 109312889 A 2/2019
JP 2011-033079 A 2/2011
(Continued)

OTHER PUBLICATIONS

Extended European Search Report dated Aug. 8, 2024 issued in Application No. 21886960.0.
(Continued)

*Primary Examiner* — Lionel Nouketcha
(74) *Attorney, Agent, or Firm* — KED & ASSOCIATES

(57) ABSTRACT

A vacuum adiabatic body may include a first plate, a second plate, and a seal which seals the first plate and the second plate to provide a vacuum space. Optionally, the vacuum adiabatic body may include a support maintaining the vacuum space. The vacuum adiabatic body may include a heat transfer resistor for reducing an amount of heat transfer between the first plate and the second plate. Optionally, the vacuum adiabatic body may include a component fastening portion which is connected to at least one of the first and second plates and to which the components are coupled. Optionally, the vacuum adiabatic body may a side plate extending in a height direction of the vacuum space. Accordingly, it is possible to provide a vacuum adiabatic body that can achieve the industrial purpose.

16 Claims, 19 Drawing Sheets

(56) References Cited

U.S. PATENT DOCUMENTS

| | | | | |
|---|---|---|---|---|
| 10,808,987 | B2 * | 10/2020 | Allard | F25D 23/062 |
| 11,137,201 | B2 | 10/2021 | Jung et al. | |
| 2012/0043873 | A1 * | 2/2012 | Jeon | F25D 23/028 312/405.1 |
| 2013/0293080 | A1 * | 11/2013 | Kim | F25D 23/00 29/890.035 |
| 2017/0176085 | A1 * | 6/2017 | Allard | F25D 23/021 |
| 2017/0184338 | A1 * | 6/2017 | Hayashino | B32B 5/18 |
| 2018/0216872 | A1 | 8/2018 | Jung et al. | |
| 2018/0224193 | A1 * | 8/2018 | Jung | F25D 19/006 |
| 2018/0231298 | A1 * | 8/2018 | Jung | F25D 23/087 |

FOREIGN PATENT DOCUMENTS

| | | | |
|---|---|---|---|
| JP | 2015-017736 | A | 1/2015 |
| JP | 2016-080281 | A | 5/2016 |
| KR | 10-2017-0016241 | A | 2/2017 |
| KR | 10-2017-0016242 | A | 2/2017 |

OTHER PUBLICATIONS

International Search Report (with English Translation) and Written Opinion dated Feb. 23, 2022 issued in Application No. PCT/KR2021/015573.

Korean Office Action dated Jul. 17, 2025, issued in Application No. 10-2020-0144749.

* cited by examiner

[Fig. 1]
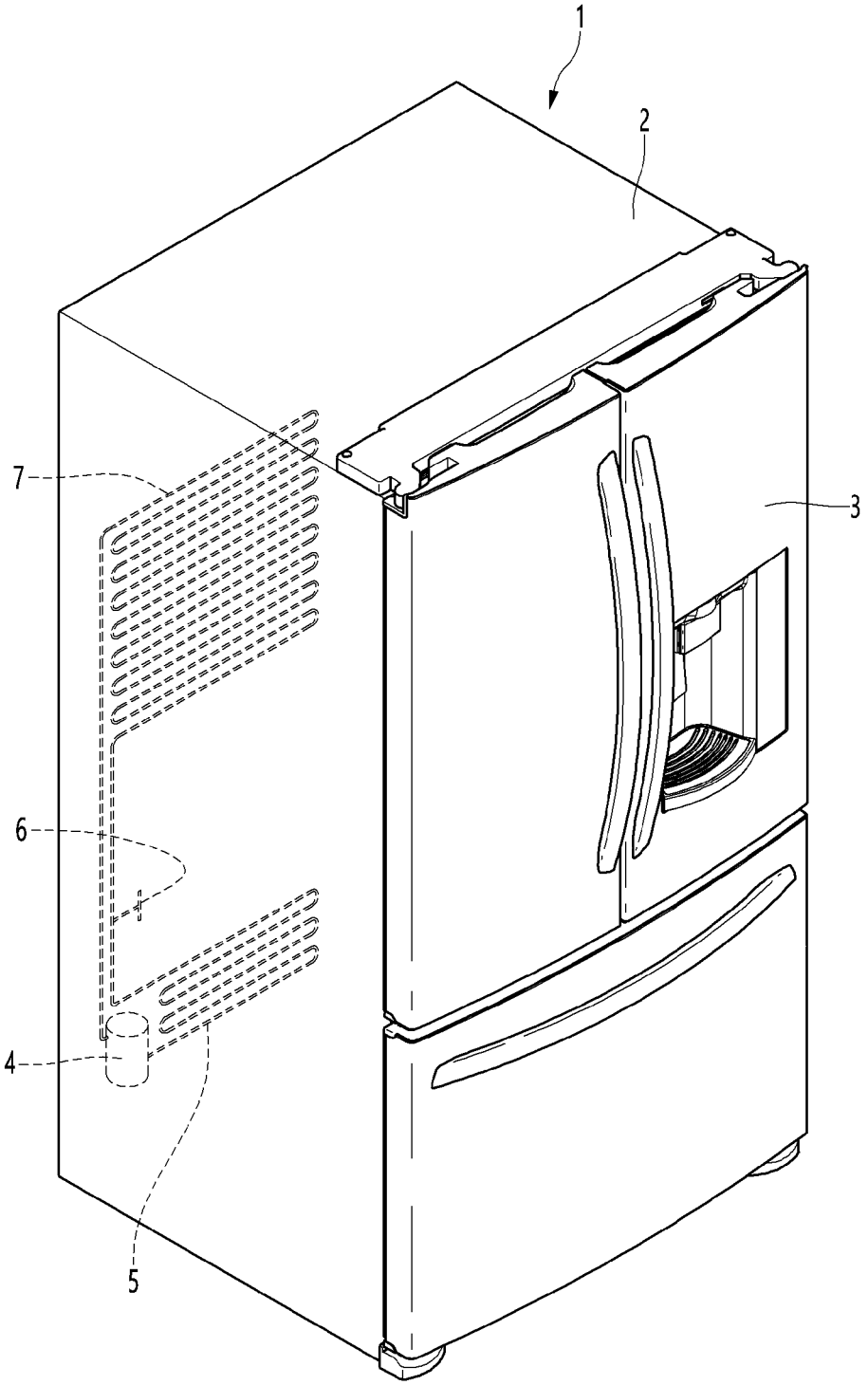

[Fig. 2]
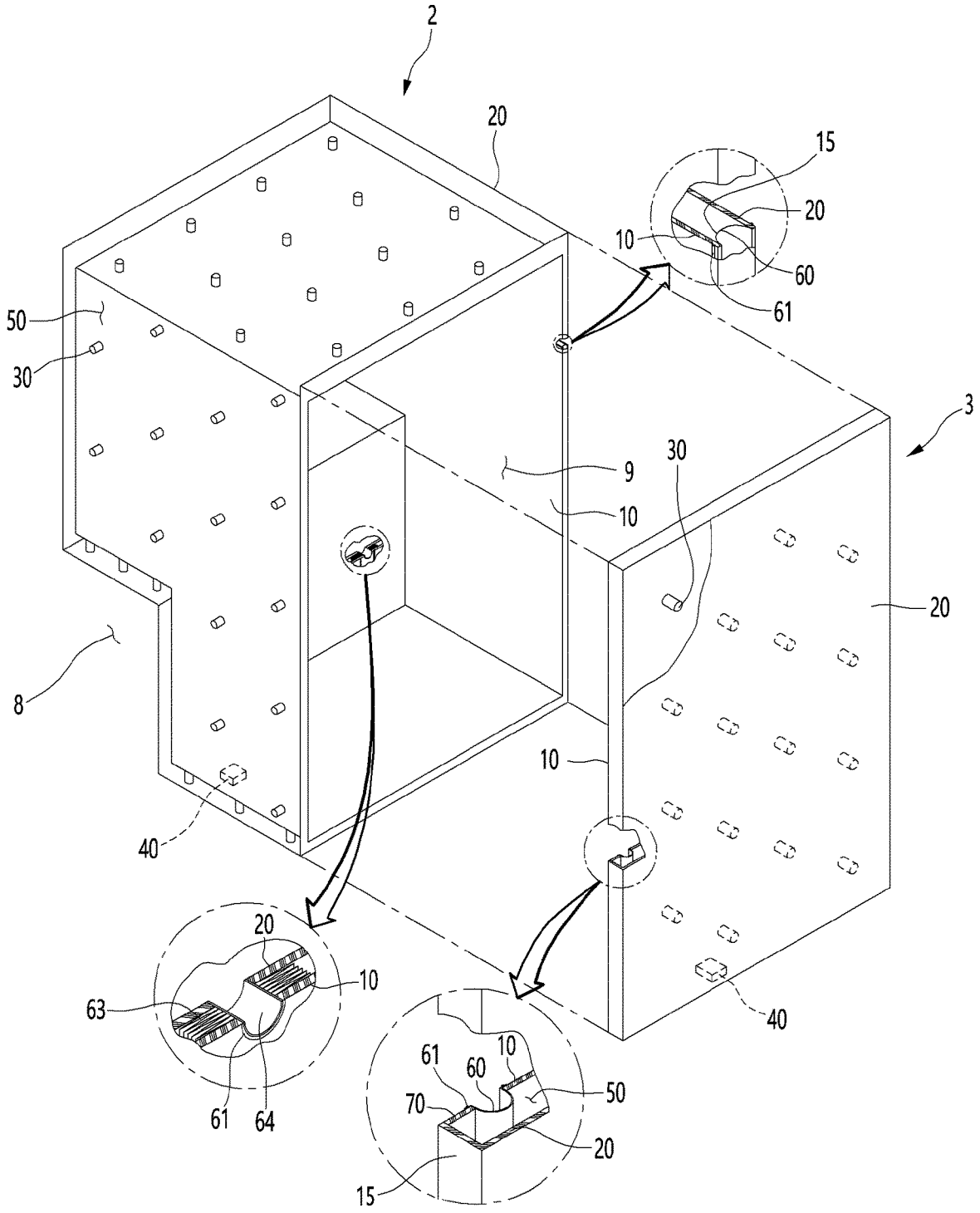

[Fig. 3]
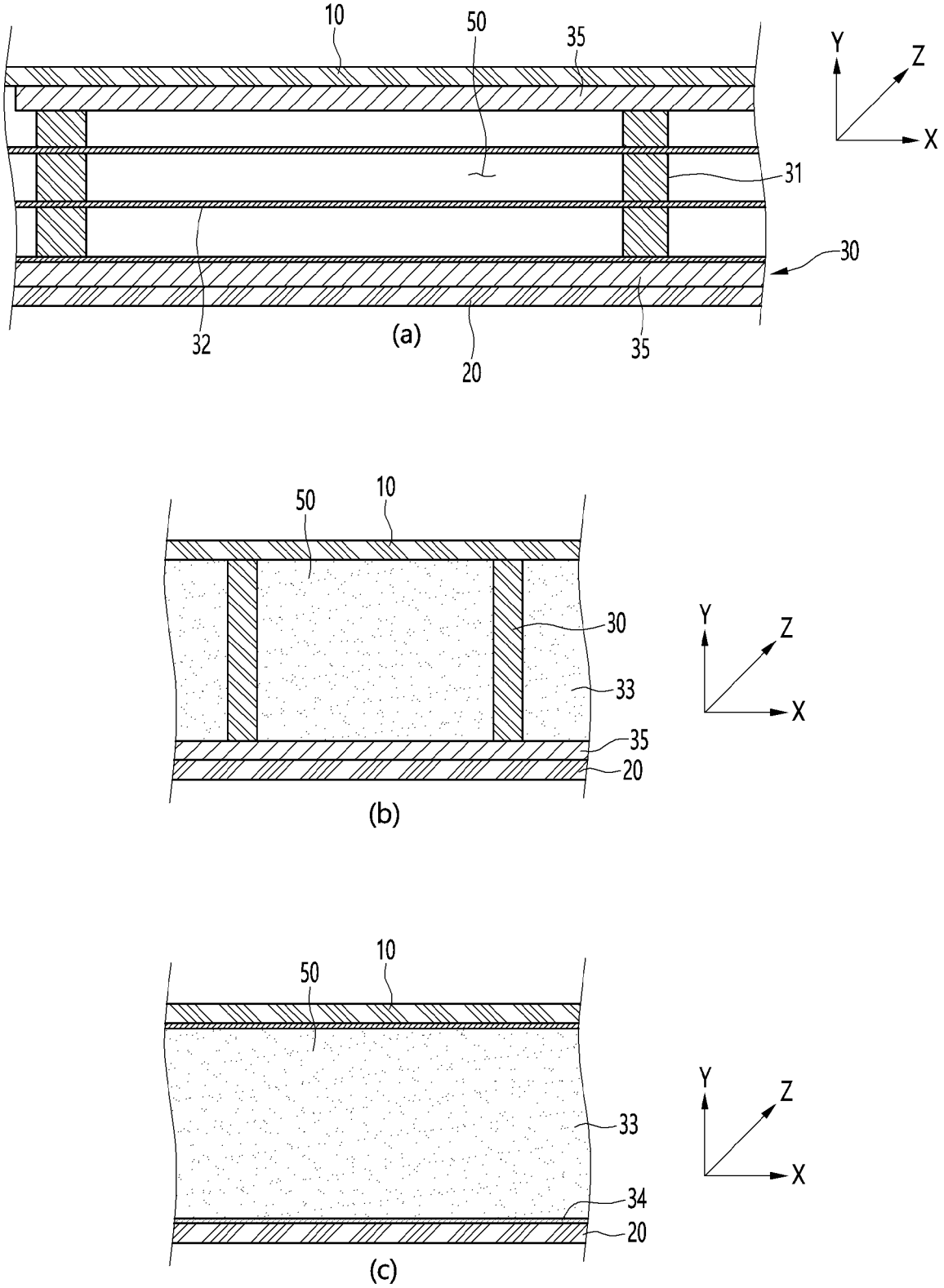

[Fig. 4]
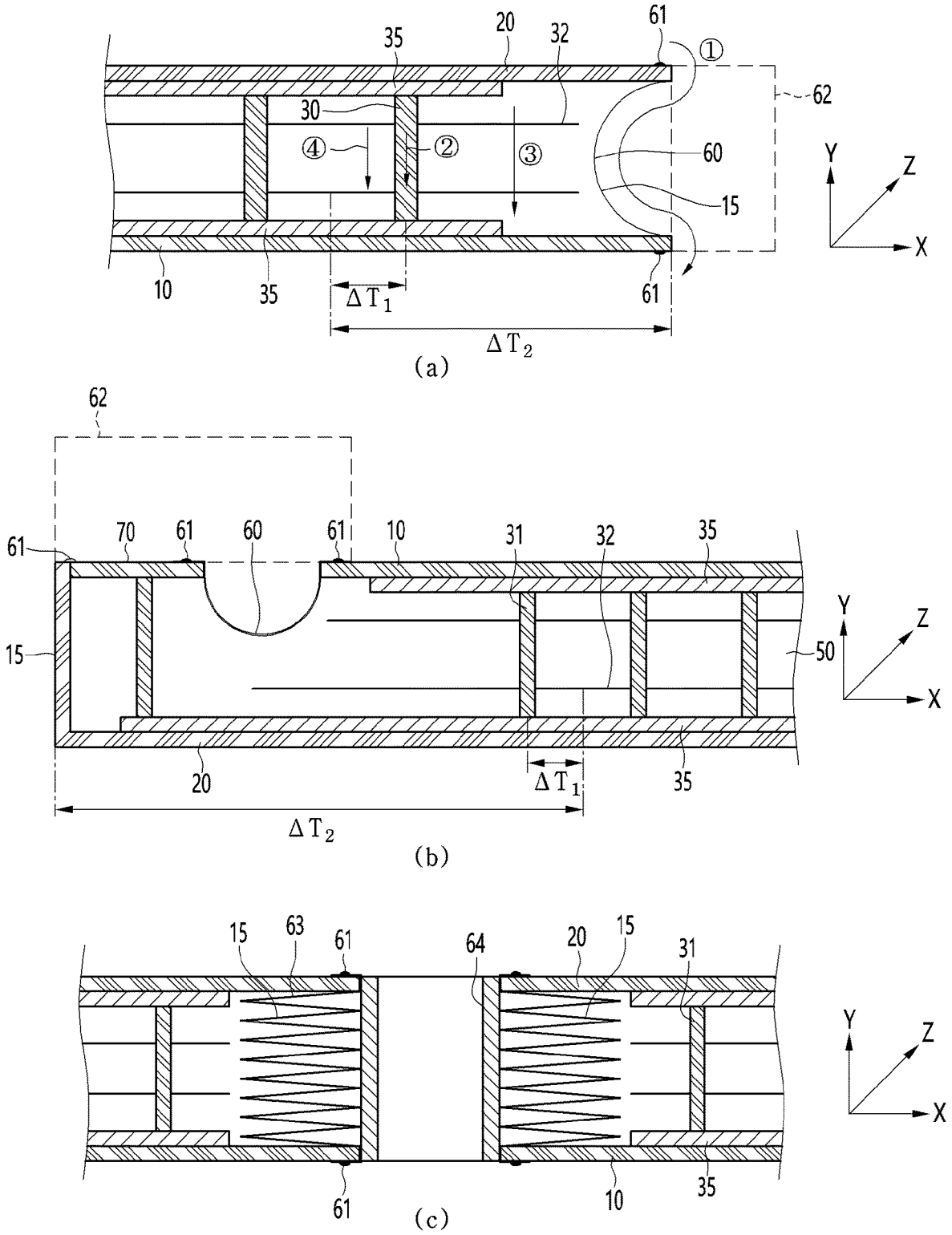

[Fig. 5]
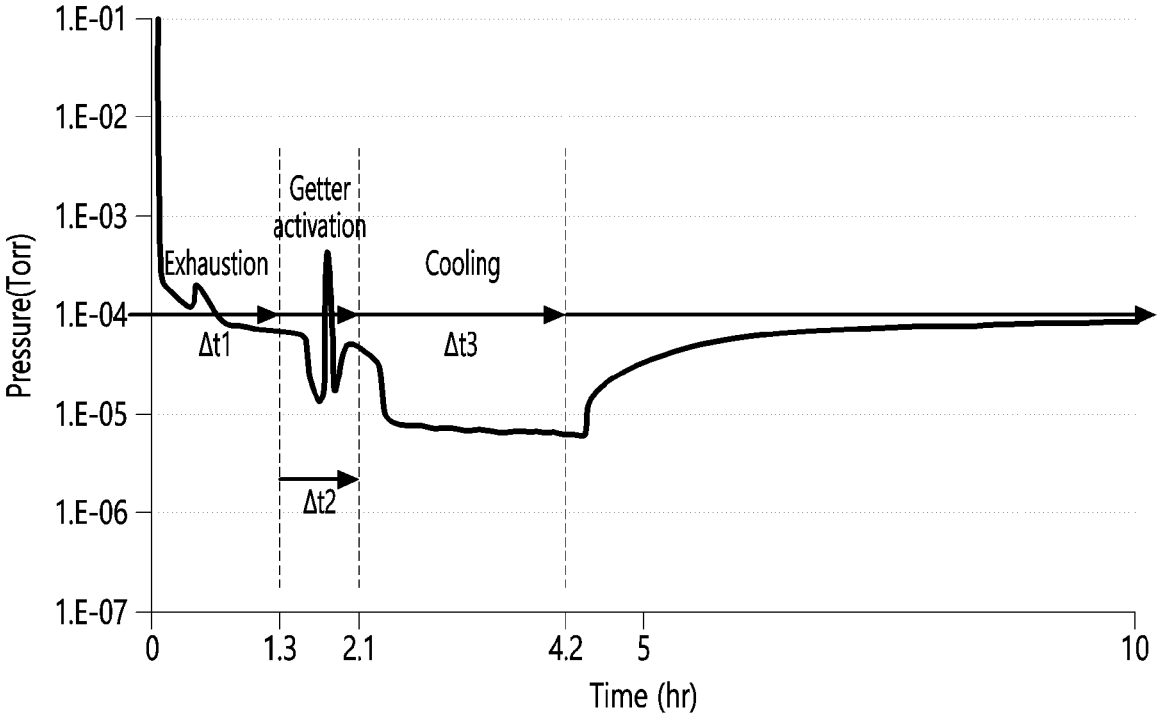
(a)
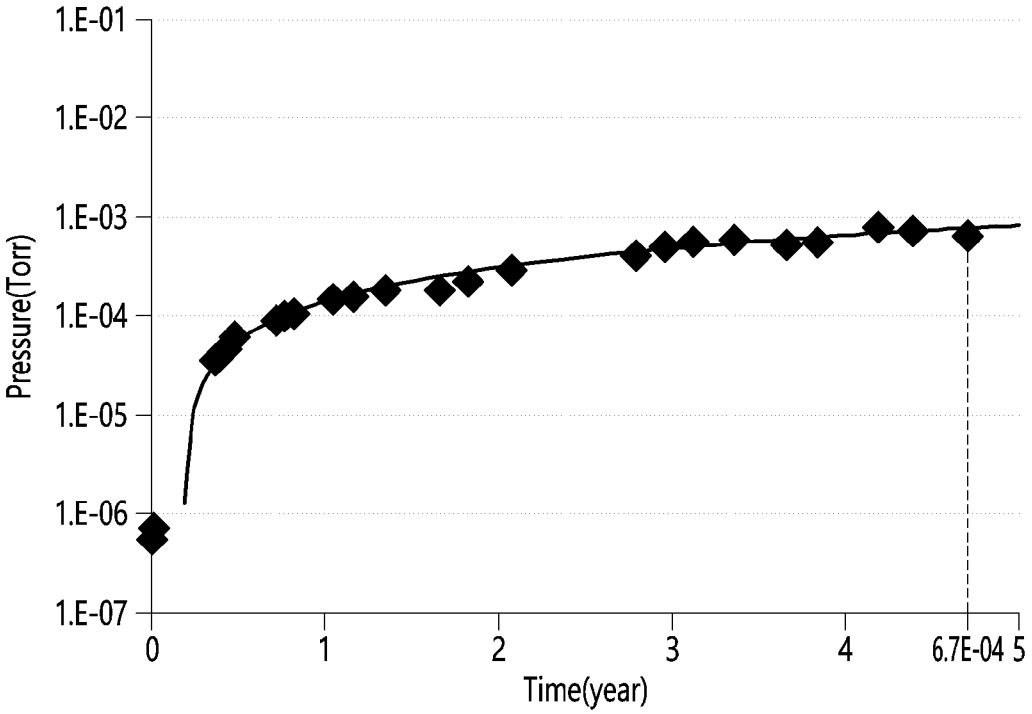
(b)

[Fig. 6]
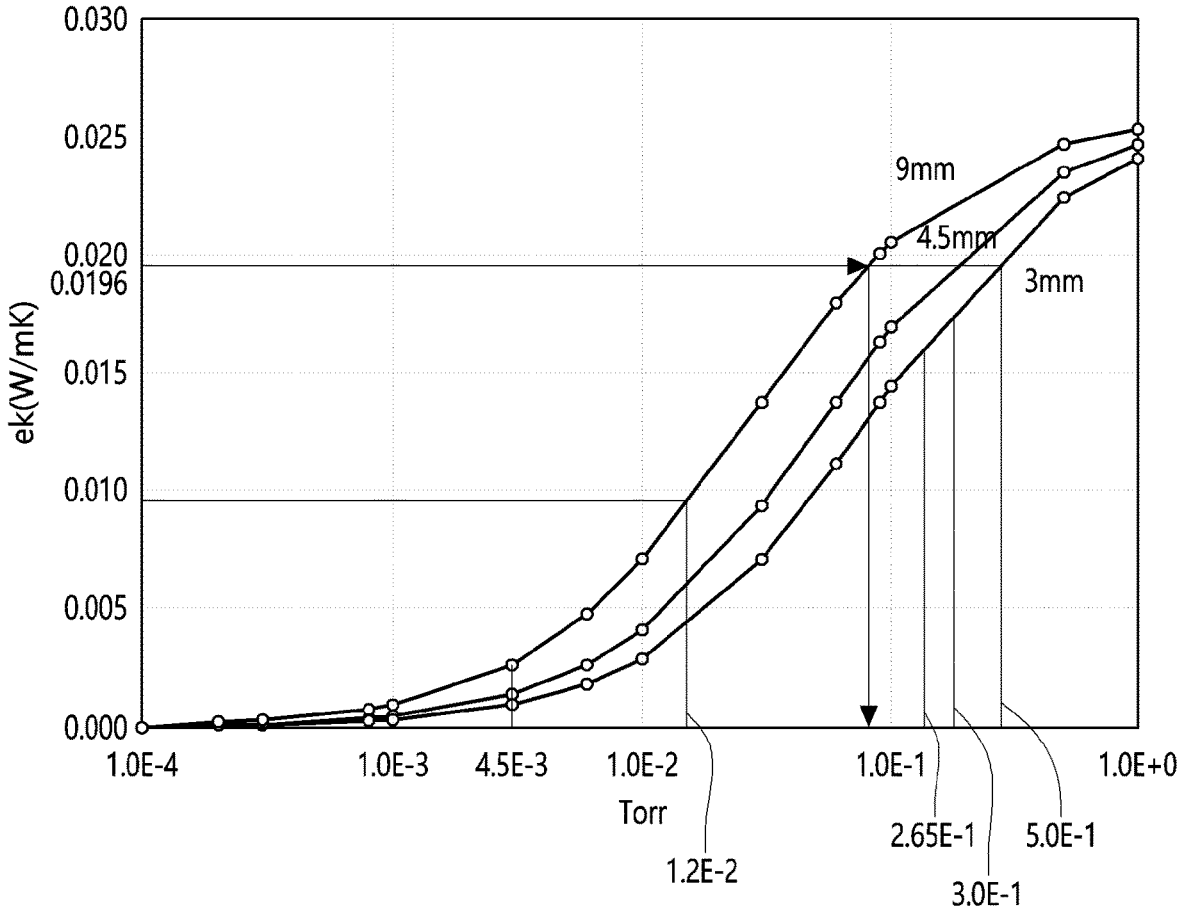

[Fig. 12]
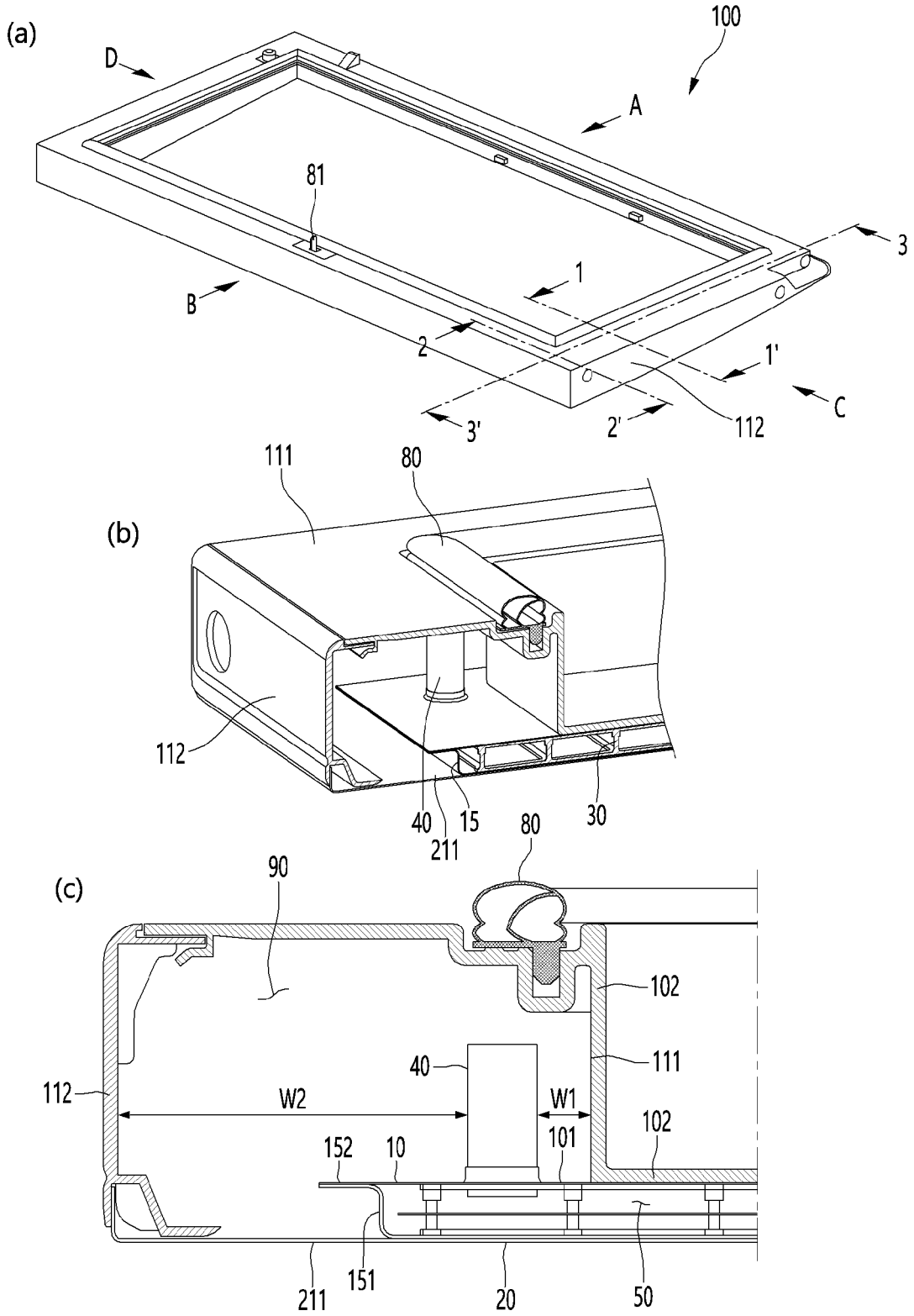

[Fig. 13]
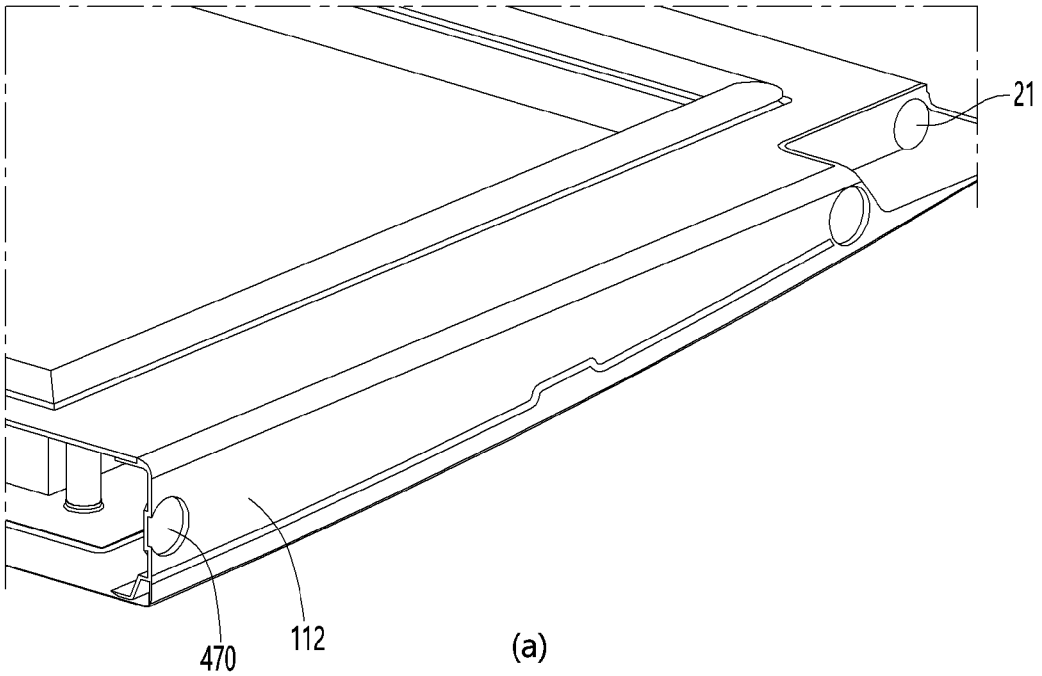
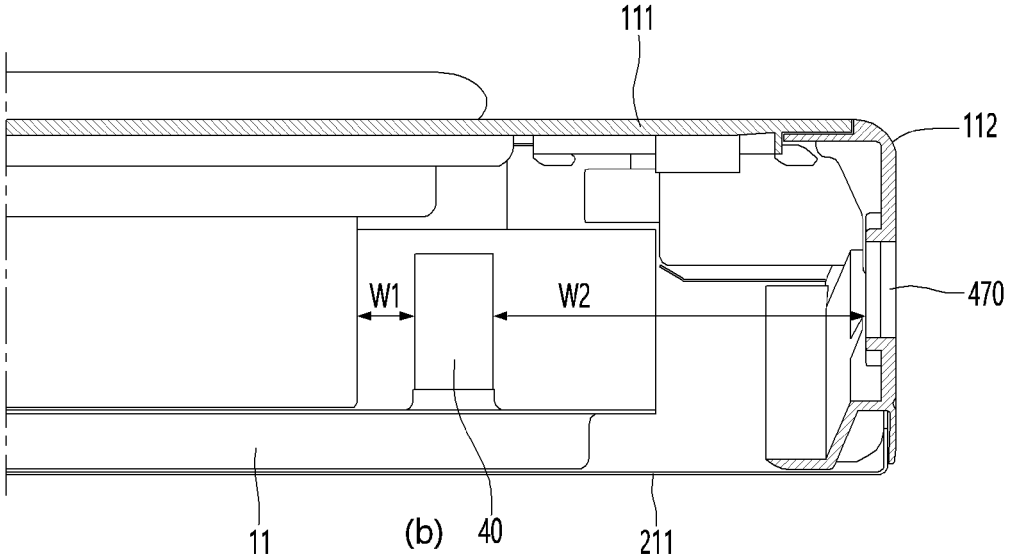

[Fig. 14]
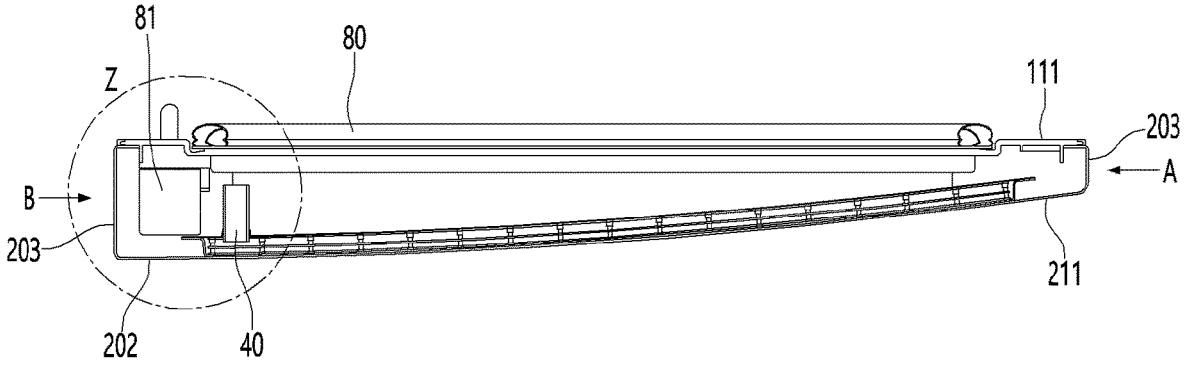
[Fig. 15]
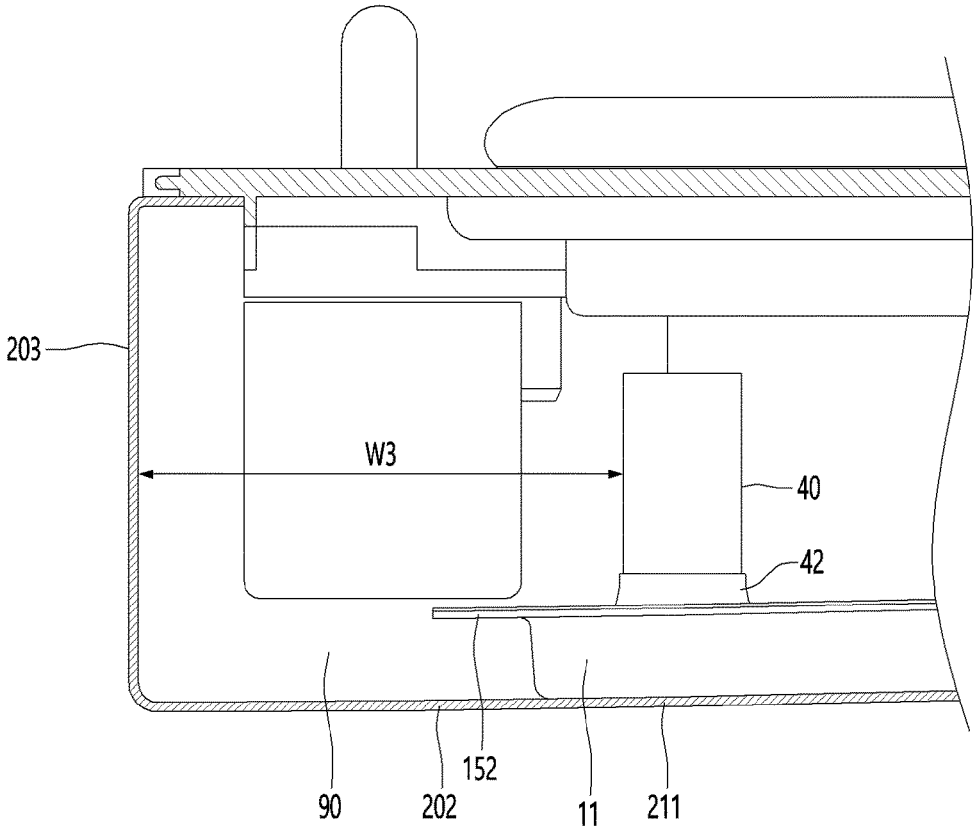

[Fig. 16]
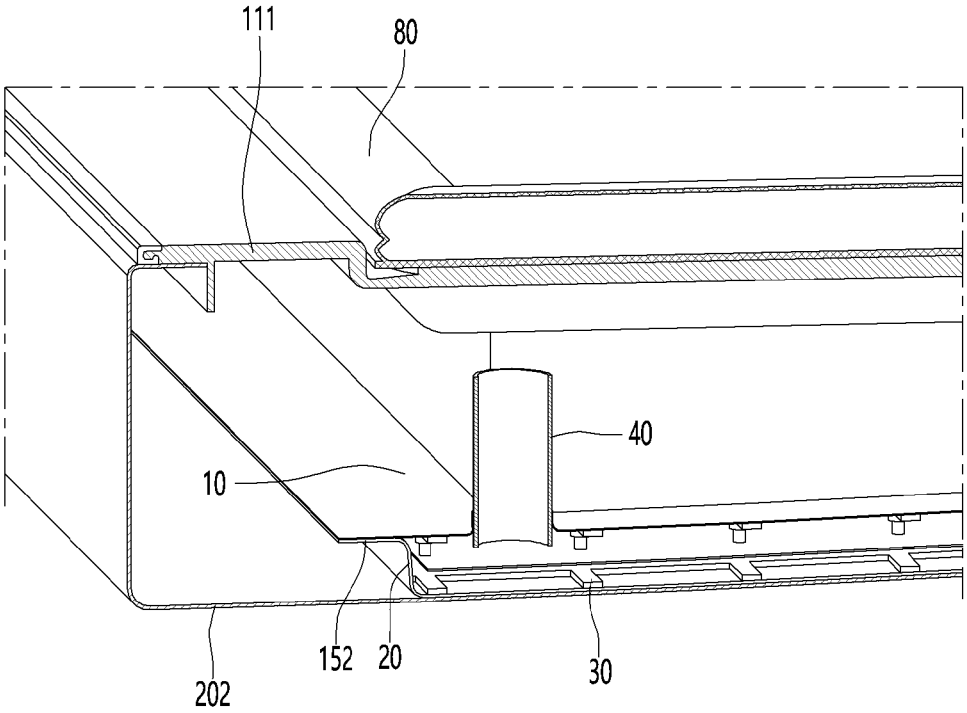

VACUUM ADIABATIC BODY

CROSS-REFERENCE TO RELATED PATENT APPLICATIONS

This application is a U.S. National Stage Application under 35 U.S.C. § 371 of PCT Application No. PCT/KR2021/015573, filed Nov. 1, 2021, which claims priority to Korean Patent Application Nos. 10-2020-0144746 and 10-2020-0144749, both filed Nov. 2, 2020, whose entire disclosures are hereby incorporated by reference.

TECHNICAL FIELD

The present disclosure relates to a vacuum adiabatic body.

BACKGROUND ART

Adiabatic performance can be improved by constructing an adiabatic wall with vacuum. At least a portion of the internal space is made of vacuum, and a device for forming to obtain an adiabatic effect may be referred to as a vacuum adiabatic body.

The applicant has developed a technology to obtain a vacuum adiabatic body that can be used in various devices and home appliances and disclosed a vacuum adiabatic body in Korean Application No. 10-2015-0109724. The vacuum adiabatic body of the cited document presents a peripheral adiabatic material placed on the periphery of the vacuum adiabatic body.

In the above document, any components, such as a latch, which are necessary to be installed in a refrigerator are not disclosed.

DISCLOSURE OF INVENTION

Technical Problem

The present disclosure is to solve the above problem and proposes a mounting structure of components such as a latch necessary for the operation of a vacuum adiabatic body.

The present disclosure proposes a vacuum adiabatic body in which components are reliably mounted without reducing the adiabatic performance of the vacuum space.

The present disclosure proposes a vacuum adiabatic body with high impact resistance.

The present disclosure proposes a vacuum adiabatic body with high impact resistance and breakage resistance.

Solution to Problem

A vacuum adiabatic body of the present disclosure may include a first plate, a second plate, and a seal which seals the first plate and the second plate to provide a vacuum space. Optionally, the vacuum adiabatic body may include a support maintaining the vacuum space. The vacuum adiabatic body may include a heat transfer resistor for reducing the amount of heat transfer between the first plate and the second plate. Optionally, the vacuum adiabatic body may include a component fastening portion which is connected to at least one of the first and second plates and to which the components are coupled. Optionally, the vacuum adiabatic body may a side plate extending in the height direction of the vacuum space. Accordingly, it is possible to provide a vacuum adiabatic body that can achieve the industrial purpose.

Optionally, the vacuum adiabatic body may include an additional adiabatic body to insulate the peripheries of the first and second plates and thus may insulate the peripheries of the first and second plates.

Optionally, the vacuum adiabatic body may include a hinge that is installed adjacent to any one side of the first and second plates and allows a rotational operation. Optionally, the vacuum space may further extend in an edge direction of the additional adiabatic body at the portion of the first side on which the hinge is installed, as compared to at the portion of the second side facing the first side. According to this configuration, it is possible to reinforce the insufficient adiabatic performance at the portion of the first side.

Optionally, the side plate may have a first portion of the side plate forming the vacuum space. Optionally, the side plate may have a second portion of a side plate having a large portion extending in the longitudinal direction of the vacuum space. Optionally, a side portion of the vacuum space may be defined by the side plate.

Optionally, the length of the vacuum space from the second portion of the first plate to the edge of the side plate in the edge direction may be longer at the portion of the first side than at the portion of the second side.

Optionally, with respect to a length of the vacuum space extending beyond the first space, which is a low-temperature space, the length at the portion of the first side may be longer than a length at the portion of the second side. According to this configuration, it is possible to reinforce the insufficient adiabatic insulation performance at the portion of the first side.

Optionally, a foam member may be accommodated in the additional adiabatic body.

Optionally, the additional adiabatic body at the portion of the first side may have a smaller thickness of the insulating wall than the additional adiabatic body at the portion of the second side.

Optionally, the side plate and the second plate may be provided as one body, and thus the vacuum adiabatic body can be manufactured more conveniently.

Optionally, the side plate may have a first portion of the side plate continuing from the second plate. Optionally, the side plate may include a second portion of the side plate extending from the first portion of the side plate in the longitudinal direction of the vacuum space.

Optionally, the first portion of the side plate may be provided so that the portion of the first side is closer to the edge of the vacuum adiabatic body than the portion of the second side. Accordingly, it is possible to improve the adiabatic performance of the adiabatic body.

Optionally, in the second part of the side plate, the first plate and the second plate may be fastened. According to the present disclosure, the method for manufacturing the vacuum adiabatic body can be simpler.

Optionally, the vacuum adiabatic body may include an additional adiabatic body to insulate the peripheries of the first and second plates. Optionally, the vacuum adiabatic body may include a hinge that allows a rotation operation. Optionally, the hinge may be installed adjacent to any one side of the first and second plates. Optionally, the length of the first portion of the first plate placed inside the additional adiabatic body may be longer at the portion of the first side than at the portion of the second side.

Optionally, the third portion 203 of the second plate may be placed on an edge of at least one of the first side and the second side, the pipe may be ports such as exhaustion ports and/or getter ports.

Optionally, prevent of the flange from interfering with at least one of the support 30 and the heat transfer resistor. At least one of the support 30 and the heat transfer resistor may be installed in plurality.

Advantageous Effects of Invention

According to the present disclosure, it is possible to increase the force to withstand the impact that is inevitably generated due to the use of the vacuum adiabatic body.

According to the present disclosure, a component such as a latch can be installed in an additional adiabatic body, and deterioration of the adiabatic performance occurring in the component can be prevented.

According to the present disclosure, the amount of impact generated by the latch and the like can be smoothly absorbed.

According to the present disclosure, the productivity of the vacuum adiabatic body is improved, and it is possible to provide a vacuum adiabatic body that can be industrially applied.

According to the present disclosure, it is possible to improve the overall adiabatic performance by balancing the adiabatic performance on two opposite sides of the vacuum adiabatic body and thus suppressing the concentration of cold air leakage.

According to the present disclosure, thermal impact of the seal is reduced, and it is possible to prevent damage to the first plate.

BRIEF DESCRIPTION OF DRAWINGS

FIG. 1 is a perspective view illustrating a refrigerator according to an embodiment, FIG. 2 is a view schematically illustrating a vacuum adiabatic body used for a body and a door of a refrigerator, FIG. 3 is a view illustrating an embodiment of a support for holding a vacuum space, FIG. 4 is a view for explaining an embodiment of a vacuum adiabatic body centering on a heat transfer resistor, FIG. 5 is a graph for observing the process of exhausting the inside of the vacuum adiabatic body with time and pressure when the support is used, FIG. 6 is a graph comparing vacuum pressure and gas conductivity, FIG. 12 is a perspective view and a partial cross-sectional view illustrating a vacuum adiabatic body, in which FIG. 12(*a*) is a vacuum adiabatic body with left side down and right side up, FIG. 12(*b*) is a partially cutaway perspective view taken along line 1-1' of FIG. 12(*a*). FIG. 12(*c*) is a cross-sectional view taken along line 1-1', FIG. 13 is a partially cutaway perspective view and a cross-sectional view illustrating a cross section taken along line 2-2' of FIG. 12(*a*), (a) is a partially cutaway perspective view, and (b) is a cross-sectional view, FIGS. 14 to 16 are views related to a cross-section taken along line 3-3' of FIG. 12(*a*), in which FIG. 14 is a cross-sectional view taken along line 3-3' of FIG. 12(*a*), FIG. 15 is an enlarged cross-sectional view of part Z in FIG. 14, and FIG. 16 is a partially cutaway perspective view.

BEST MODE FOR CARRYING OUT THE INVENTION

Figure 7:
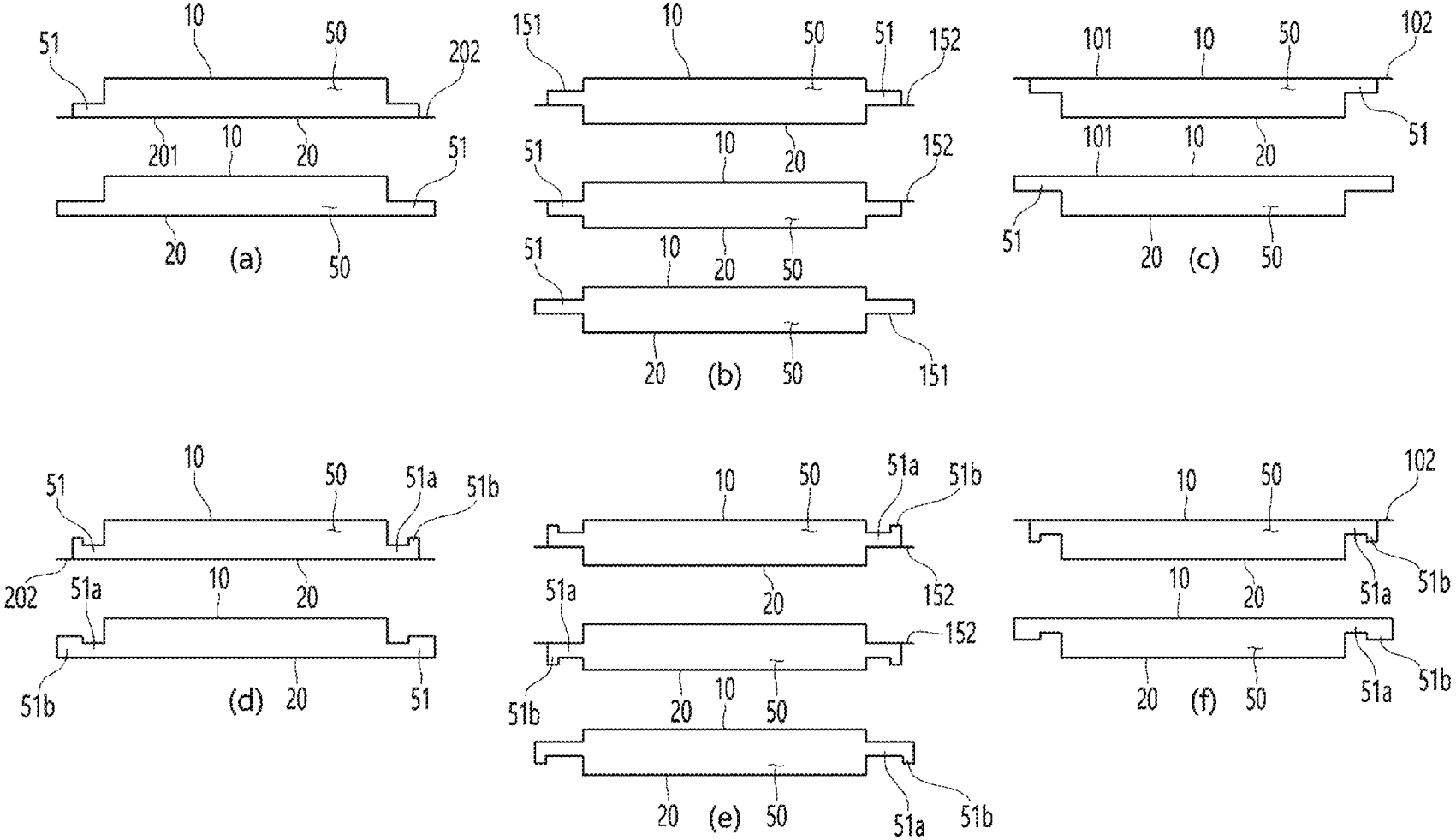
FIG. 7 is a view illustrating various embodiments of a vacuum space.

Hereinafter, specific embodiments will be described in detail with reference to the accompanying drawings. The invention may, however, be embodied in many different forms and should not be construed as being limited to the embodiments set forth herein, and a person of ordinary skill in the art, who understands the spirit of the present invention, may readily implement other embodiments included within the scope of the same concept by adding, changing, deleting, and adding components; rather, it will be understood that they are also included within the scope of the present invention. The present invention may have many embodiments in which the idea is implemented, and in each embodiment, any portion may be replaced with a corresponding portion or a portion having a related action according to another embodiment. The present invention may be any one of the examples presented below or a combination of two or more examples.

The present disclosure relates to a vacuum adiabatic body including a first plate; a second plate; a vacuum space defined between the first and second plates; and a seal providing the vacuum space that is in a vacuum state. The vacuum space may be a space in a vacuum state provided in an internal space between the first plate and the second plate. The seal may seal the first plate and the second plate to provide the internal space provided in the vacuum state. The vacuum adiabatic body may optionally include a side plate connecting the first plate to the second plate. In the present disclosure, the expression "plate" may mean at least one of the first and second plates or the side plate. At least a portion of the first and second plates and the side plate may be integrally provided, or at least portions may be sealed to each other. Optionally, the vacuum adiabatic body may include a support that maintains the vacuum space. The vacuum adiabatic body may selectively include a thermal insulator that reduces an amount of heat transfer between a first space provided in vicinity of the first plate and a second space provided in vicinity of the second plate or reduces an amount of heat transfer between the first plate and the second plate. Optionally, the vacuum adiabatic body may include a component coupling portion provided on at least a portion of the plate. Optionally, the vacuum adiabatic body may include another adiabatic body. Another adiabatic body may be provided to be connected to the vacuum adiabatic body. Another adiabatic body may be an adiabatic body having a degree of vacuum, which is equal to or different from a degree of vacuum of the vacuum adiabatic body. Another adiabatic body may be an adiabatic body that does not include a degree of vacuum less than that of the vacuum adiabatic body or a portion that is in a vacuum state therein.

In this case, it may be advantageous to connect another object to another adiabatic body.

In the present disclosure, a direction along a wall defining the vacuum space may include a longitudinal direction of the vacuum space and a height direction of the vacuum space. The height direction of the vacuum space may be defined as any one direction among virtual lines connecting the first space to the second space to be described later while passing through the vacuum space. The longitudinal direction of the vacuum space may be defined as a direction perpendicular to the set height direction of the vacuum space. In the present disclosure, that an object A is connected to an object B means that at least a portion of the object A and at least a portion of the object B are directly connected to each other, or that at least a portion of the object A and at least a portion of the object B are connected to each other through an intermedium interposed between the objects A and B. The intermedium may be provided on at least one of the object A or the object B. The connection may include that the object A is connected to the intermedium, and the intermedium is connected to the object B. A portion of the intermedium may include a portion connected to either one of the object A and the object B. The other portion of the intermedium may include a portion connected to the other of the object A and the object B. As a modified example, the connection of the object A to the object B may include that the object A and the object B are integrally prepared in a shape connected in the above-described manner. In the present disclosure, an embodiment of the connection may be support, combine, or a seal, which will be described later. In the present disclosure, that the object A is supported by the object B means that the object A is restricted in movement by the object B in one or more of the +X, −X, +Y, −Y, +Z, and −Z axis directions. In the present invention, an embodiment of the support may be the combine or seal, which will be described later. In the present invention, that the object A is combined with the object B may define that the object A is restricted in movement by the object B in one or more of the X, Y, and Z-axis directions. In the present disclosure, an embodiment of the combining may be the sealing to be described later. In the present disclosure, that the object A is sealed to the object B may define a state in which movement of a fluid is not allowed at the portion at which the object A and the object B are connected. In the present disclosure, one or more objects, i.e., at least a portion of the object A and the object B, may be defined as including a portion of the object A, the whole of the object A, a portion of the object B, the whole of the object B, a portion of the object A and a portion of the object B, a portion of the object A and the whole of the object B, the whole of the object A and a portion of the object B, and the whole of the object A and the whole of the object B. In the present disclosure, that the plate A may be a wall defining the space A may be defined as that at least a portion of the plate A may be a wall defining at least a portion of the space A. That is, at least a portion of the plate A may be a wall forming the space A, or the plate A may be a wall forming at least a portion of the space A. In the present disclosure, a central portion of the object may be defined as a central portion among three divided portions when the object is divided into three sections based on the longitudinal direction of the object. A periphery of the object may be defined as a portion disposed at a left or right side of the central portion among the three divided portions. The periphery of the object may include a surface that is in contact with the central portion and a surface opposite thereto. The opposite side may be defined as a border or edge of the object. Examples of the object may include a vacuum adiabatic body, a plate, a heat transfer resistor, a support, a vacuum space, and various components to be introduced in the present disclosure. In the present disclosure, a degree of heat transfer resistance may indicate a degree to which an object resists heat transfer and may be defined as a value determined by a shape including a thickness of the object, a material of the object, and a processing method of the object. The degree of the heat transfer resistance may be defined as the sum of a degree of conduction resistance, a degree of radiation resistance, and a degree of convection resistance. The vacuum adiabatic body according to the present disclosure may include a heat transfer path defined between spaces having different temperatures, or a heat transfer path defined between plates having different temperatures. For example, the vacuum adiabatic body according to the present disclosure may include a heat transfer path through which cold is transferred from a low-temperature plate to a high-temperature plate. In the present disclosure, when a curved portion includes a first portion extending in a first direction and a second portion extending in a second direction different from the first direction, the curved portion may be defined as a portion that connects the first portion to the second portion (including 90 degrees).

In the present disclosure, the vacuum adiabatic body may optionally include a component coupling portion. The component coupling portion may be defined as a portion provided on the plate to which components are connected to each other. The component connected to the plate may be defined as a penetration portion disposed to pass through at least a portion of the plate and a surface component disposed to be connected to a surface of at least a portion of the plate. At least one of the penetration component or the surface component may be connected to the component coupling portion. The penetration component may be a component that defines a path through which a fluid (electricity, refrigerant, water, air, etc.) passes mainly. In the present disclosure, the fluid is defined as any kind of flowing material. The fluid includes moving solids, liquids, gases, and electricity. For example, the component may be a component that defines a path through which a refrigerant for heat exchange passes, such as a suction line heat exchanger (SLHX) or a refrigerant tube. The component may be an electric wire that supplies electricity to an apparatus. As another example, the component may be a component that defines a path through which air passes, such as a cold duct, a hot air duct, and an exhaust port. As another example, the component may be a path through which a fluid such as coolant, hot water, ice, and defrost water pass. The surface component may include at least one of a peripheral adiabatic body, a side panel, injected foam, a pre-prepared resin, a hinge, a latch, a basket, a drawer, a shelf, a light, a sensor, an evaporator, a front decor, a hotline, a heater, an exterior cover, or another adiabatic body.

As an example to which the vacuum adiabatic body is applied, the present disclosure may include an apparatus having the vacuum adiabatic body. Examples of the apparatus may include an appliance. Examples of the appliance may include home appliances including a refrigerator, a cooking appliance, a washing machine, a dishwasher, and an air conditioner, etc. As an example in which the vacuum adiabatic body is applied to the apparatus, the vacuum adiabatic body may constitute at least a portion of a body and a door of the apparatus. As an example of the door, the vacuum adiabatic body may constitute at least a portion of a general door and a door-in-door (DID) that is in direct contact with the body. Here, the door-in-door may mean a small door placed inside the general door. As another example to which the vacuum adiabatic body is applied, the present disclosure may include a wall having the vacuum adiabatic body. Examples of the wall may include a wall of a building, which includes a window.

Hereinafter, the present disclosure will be described in detail with reference to the accompanying drawings. Each of the drawings accompanying the embodiment may be different from, exaggerated, or simply indicated from an actual article, and detailed components may be indicated with simplified features. The embodiment should not be interpreted as being limited only to the size, structure, and shape presented in the drawings. In the embodiments accompanying each of the drawings, unless the descriptions conflict with each other, some configurations in the drawings of one embodiment may be applied to some configurations of the drawings in another embodiment, and some structures in one embodiment may be applied to some structures in another embodiment. In the description of the drawings for the embodiment, the same reference numerals may be assigned to different drawings as reference numerals of specific components constituting the embodiment. Components having the same reference number may perform the same function. For example, the first plate constituting the vacuum adiabatic body has a portion corresponding to the first space throughout all embodiments and is indicated by reference number 10. The first plate may have the same number for all embodiments and may have a portion corresponding to the first space, but the shape of the first plate may be different in each embodiment. Not only the first plate, but also the side plate, the second plate, and another adiabatic body may be understood as well.

FIG. 1 is a perspective view of a refrigerator according to an embodiment, and FIG. 2 is a schematic view illustrating a vacuum adiabatic body used for a body and a door of the refrigerator. Referring to FIG. 1, the refrigerator 1 includes a main body 2 provided with a cavity 9 capable of storing storage goods and a door 3 provided to open and close the main body 2. The door 3 may be rotatably or slidably disposed to open or close the cavity 9. The cavity 9 may provide at least one of a refrigerating compartment and a freezing compartment. A cold source that supplies cold to the cavity may be provided. For example, the cold source may be an evaporator 7 that evaporates the refrigerant to take heat. The evaporator 7 may be connected to a compressor 4 that compresses the refrigerant evaporated to the cold source. The evaporator 7 may be connected to a condenser 5 that condenses the compressed refrigerant to the cold source. The evaporator 7 may be connected to an expander 6 that expands the refrigerant condensed in the cold source. A fan corresponding to the evaporator and the condenser may be provided to promote heat exchange. As another example, the cold source may be a heat absorption surface of a thermoelectric element. A heat absorption sink may be connected to the heat absorption surface of the thermoelectric element. A heat sink may be connected to a heat radiation surface of the thermoelectric element. A fan corresponding to the heat absorption surface and the heat generation surface may be provided to promote heat exchange.

Referring to FIG. 2, plates 10, 15, and 20 may be walls defining the vacuum space. The plates may be walls that partition the vacuum space from an external space of the vacuum space. An example of the plates is as follows. The present disclosure may be any one of the following examples or a combination of two or more examples.

The plate may be provided as one portion or may be provided to include at least two portions connected to each other. As a first example, the plate may include at least two portions connected to each other in a direction along a wall defining the vacuum space. Any one of the two portions may include a portion (e.g., a first portion) defining the vacuum space. The first portion may be a single portion or may include at least two portions that are sealed to each other. The other one of the two portions may include a portion (e.g., a second portion) extending from the first portion of the first plate in a direction away from the vacuum space or extending in an inner direction of the vacuum space. As a second example, the plate may include at least two layers connected to each other in a thickness direction of the plate. Any one of the two layers may include a layer (e.g., the first portion) defining the vacuum space. The other one of the two layers may include a portion (e.g., the second portion) provided in an external space (e.g., a first space and a second space) of the vacuum space. In this case, the second portion may be defined as an outer cover of the plate. The other one of the two layers may include a portion (e.g., the second portion) provided in the vacuum space. In this case, the second portion may be defined as an inner cover of the plate.

The plate may include a first plate 10 and a second plate 20. One surface of the first plate (the inner surface of the first plate) provides a wall defining the vacuum space, and the other surface (the outer surface of the first plate) of the first plate A wall defining the first space may be provided. The first space may be a space provided in the vicinity of the first plate, a space defined by the apparatus, or an internal space of the apparatus. In this case, the first plate may be referred to as an inner case. When the first plate and the additional member define the internal space, the first plate and the additional member may be referred to as an inner case. The inner case may include two or more layers. In this case, one of the plurality of layers may be referred to as an inner panel. One surface of the second plate (the inner surface of the second plate) provides a wall defining the vacuum space, and the other surface (the outer surface of the first plate) of the second plate A wall defining the second space may be provided. The second space may be a space provided in vicinity of the second plate, another space defined by the apparatus, or an external space of the apparatus. In this case, the second plate may be referred to as an outer case. When the second plate and the additional member define the external space, the second plate and the additional member may be referred to as an outer case. The outer case may include two or more layers. In this case, one of the plurality of layers may be referred to as an outer panel. The second space may be a space having a temperature higher than that of the first space or a space having a temperature lower than that of the first space. Optionally, the plate may include a side plate 15. In FIG. 2, the side plate may also perform a function of a conductive resistance sheet 60 to be described later, according to the disposition of the side plate. The side plate may include a portion extending in a height direction of a space defined between the first plate and the second plate or a portion extending in a height direction of the vacuum space. One surface of the side plate may provide a wall defining the vacuum space, and the other surface of the side plate may provide a wall defining an external space of the vacuum space. The external space of the vacuum space may be at least one of the first space or the second space or a space in which another adiabatic body to be described later is disposed. The side plate may be integrally provided by extending at least one of the first plate or the second plate or a separate component connected to at least one of the first plate or the second plate.

The plate may optionally include a curved portion. In the present disclosure, the plate including a curved portion may be referred to as a bent plate. The curved portion may include at least one of the first plate, the second plate, the side plate, between the first plate and the second plate, between the first plate and the side plate, or between the second plate and the side plate. The plate may include at least one of a first curved portion or a second curved portion, an example of which is as follows. First, the side plate may include the first curved portion. A portion of the first curved portion may include a portion connected to the first plate. Another portion of the first curved portion may include a portion connected to the second curved portion. In this case, a curvature radius of each of the first curved portion and the second curved portion may be large. The other portion of the first curved portion may be connected to an additional straight portion or an additional curved portion, which are provided between the first curved portion and the second curved portion. In this case, a curvature radius of each of the first curved portion and the second curved portion may be small. Second, the side plate may include the second curved portion. A portion of the second curved portion may include a portion connected to the second plate. The other portion of the second curved portion may include a portion connected to the first curved portion. In this case, a curvature radius of each of the first curved portion and the second curved portion may be large. The other portion of the second curved portion may be connected to an additional straight portion or an additional curved portion, which are provided between the first curved portion and the second curved portion. In this case, a curvature radius of each of the first curved portion and the second curved portion may be small. Here, the straight portion may be defined as a portion having a curvature radius greater than that of the curved portion. The straight portion may be understood as a portion having a perfect plane or a curvature radius greater than that of the curved portion. Third, the first plate may include the first curved portion. A portion of the first curved portion may include a portion connected to the side plate. A portion connected to the side plate may be provided at a position that is away from the second plate at a portion at which the first plate extends in the longitudinal direction of the vacuum space. Fourth, the second plate may include the second curved portion. A portion of the second curved portion may include a portion connected to the side plate. A portion connected to the side plate may be provided at a position that is away from the first plate at a portion at which the second plate extends in the longitudinal direction of the vacuum space. The present disclosure may include a combination of any one of the first and second examples described above and any one of the third and fourth examples described above.

In the present disclosure, the vacuum space 50 may be defined as a third space. The vacuum space may be a space in which a vacuum pressure is maintained. In the present disclosure, the expression that a vacuum degree of A is higher than that of B means that a vacuum pressure of A is lower than that of B.

In the present disclosure, the seal 61 may be a portion provided between the first plate and the second plate. Examples of scaling are as follows. The present disclosure may be any one of the following examples or a combination of two or more examples. The sealing may include fusion welding for coupling the plurality of objects by melting at least a portion of the plurality of objects. For example, the first plate and the second plate may be welded by laser welding in a state in which a melting bond such as a filler metal is not interposed therebetween, a portion of the first and second plates and a portion of the component coupling portion may be welded by high-frequency brazing or the like, or a plurality of objects may be welded by a melting bond that generates heat. The scaling may include pressure welding for coupling the plurality of objects by a mechanical pressure applied to at least a portion of the plurality of objects. For example, as a component connected to the component coupling portion, an object made of a material having a degree of deformation resistance less than that of the plate may be pressure-welded by a method such as pinch-off.

A machine room 8 may be optionally provided outside the vacuum adiabatic body. The machine room may be defined as a space in which components connected to the cold source are accommodated. Optionally, the vacuum adiabatic body may include a port 40. The port may be provided at any one side of the vacuum adiabatic body to discharge air of the vacuum space 50. Optionally, the vacuum adiabatic body may include a conduit 64 passing through the vacuum space 50 to install components connected to the first space and the second space.

FIG. 3 is a view illustrating an example of a support that maintains the vacuum space. An example of the support is as follows. The present disclosure may be any one of the following examples or a combination of two or more examples.

The supports 30, 31, 33, and 35 may be provided to support at least a portion of the plate and a heat transfer resistor to be described later, thereby reducing deformation of at least some of the vacuum space 50, the plate, and the heat transfer resistor to be described later due to external force. The external force may include at least one of a vacuum pressure or external force excluding the vacuum pressure. When the deformation occurs in a direction in which a height of the vacuum space is lower, the support may reduce an increase in at least one of radiant heat conduction, gas heat conduction, surface heat conduction, or support heat conduction, which will be described later. The support may be an object provided to maintain a gap between the first plate and the second plate or an object provided to support the heat transfer resistor. The support may have a degree of deformation resistance greater than that of the plate or be provided to a portion having weak degree of deformation resistance among portions constituting the vacuum adiabatic body, the apparatus having the vacuum adiabatic body, and the wall having the vacuum adiabatic body. According to an embodiment, a degree of deformation resistance represents a degree to which an object resists deformation due to external force applied to the object and is a value determined by a shape including a thickness of the object, a material of the object, a processing method of the object, and the like. Examples of the portions having the weak degree of deformation resistance include the vicinity of the curved portion defined by the plate, at least a portion of the curved portion, the vicinity of an opening defined in the body of the apparatus, which is provided by the plate, or at least a portion of the opening. The support may be disposed to surround at least a portion of the curved portion or the opening or may be provided to correspond to the shape of the curved portion or the opening. However, it is not excluded that the support is provided in other portions. The opening may be understood as a portion of the apparatus including the body and the door capable of opening or closing the opening defined in the body.

An example in which the support is provided to support the plate is as follows. First, at least a portion of the support may be provided in a space defined inside the plate. The plate may include a portion including a plurality of layers, and the support may be provided between the plurality of layers. Optionally, the support may be provided to be connected to at least a portion of the plurality of layers or be provided to support at least a portion of the plurality of layers. Second, at least a portion of the support may be provided to be connected to a surface defined on the outside of the plate. The support may be provided in the vacuum space or an external space of the vacuum space. For example, the plate may include a plurality of layers, and the support may be provided as any one of the plurality of layers. Optionally, the support may be provided to support the other one of the plurality of layers. For example, the plate may include a plurality of portions extending in the longitudinal direction, and the support may be provided as any one of the plurality of portions. Optionally, the support may be provided to support the other one of the plurality of parts. As further another example, the support may be provided in the vacuum space or the external space of the vacuum space as a separate component, which is distinguished from the plate. Optionally, the support may be provided to support at least a portion of a surface defined on the outside of the plate. Optionally, the support may be provided to support one surface of the first plate and one surface of the second plate, and one surface of the first plate and one surface of the second plate may be provided to face each other. Third, the support may be provided to be integrated with the plate. An example in which the support is provided to support the heat transfer resistor may be understood instead of the example in which the support is provided to support the plate. A duplicated description will be omitted.

An example of the support in which heat transfer through the support is designed to be reduced is as follows. First, at least a portion of the components disposed in the vicinity of the support may be provided so as not to be in contact with the support or provided in an empty space provided by the support. Examples of the components include a tube or component connected to the heat transfer resistor to be described later, an exhaust port, a getter port, a tube or component passing through the vacuum space, or a tube or component of which at least a portion is disposed in the vacuum space. Examples of the empty space may include an empty space provided in the support, an empty space provided between the plurality of supports, and an empty space provided between the support and a separate component that is distinguished from the support. Optionally, at least a portion of the component may be disposed in a through-hole defined in the support, be disposed between the plurality of bars, be disposed between the plurality of connection plates, or be disposed between the plurality of support plates. Optionally, at least a portion of the component may be disposed in a spaced space between the plurality bars, be disposed in a spaced space between the plurality of connection plates, or be disposed in a spaced space between the plurality of support plates. Second, the adiabatic body may be provided on at least a portion of the support or in the vicinity of at least a portion of the support. The adiabatic body may be provided to be in contact with the support or provided so as not to be in contact with the support. The adiabatic body may be provided at a portion in which the support and the plate are in contact with each other. The adiabatic body may be provided on at least a portion of one surface and the other surface of the support or be provided to cover at least a portion of one surface and the other surface of the support. The adiabatic body may be provided on at least a portion of a periphery of one surface and a periphery of the other surface of the support or be provided to cover at least a portion of a periphery of one surface and a periphery of the other surface of the support. The support may include a plurality of bars, and the adiabatic body may be disposed on an area from a point at which any one of the plurality of bars is disposed to a midpoint between the one bar and the surrounding bars. Third, when cold is transferred through the support, a heat source may be disposed at a position at which the heat adiabatic body described in the second example is disposed. When a temperature of the first space is lower than a temperature of the second space, the heat source may be disposed on the second plate or in the vicinity of the second plate. When heat is transmitted through the support, a cold source may be disposed at a position at which the heat adiabatic body described in the second example is disposed. When a temperature of the first space is higher than a temperature of the second space, the cold source may be disposed on the second plate or in the vicinity of the second plate. As fourth example, the support may include a portion having heat transfer resistance higher than a metal or a portion having heat transfer resistance higher than the plate. The support may include a portion having heat transfer resistance less than that of another adiabatic body. The support may include at least one of a non-metal material, PPS, and glass fiber (GF), low outgassing PC, PPS, or LCP. This is done for a reason in which high compressive strength, low outgassing, and a water absorption rate, low thermal conductivity, high compressive strength at a high temperature, and excellent workability are being capable of obtained.

Examples of the support may be the bars 30 and 31, the connection plate 35, the support plate 35, a porous material 33, and a filler 33. In this embodiment, the support may include any one of the above examples, or an example in which at least two examples are combined. As first example, the support may include bars 30 and 31. The bar may include a portion extending in a direction in which the first plate and the second plate are connected to each other to support a gap between the first plate and the second plate. The bar may include a portion extending in a height direction of the vacuum space and a portion extending in a direction that is substantially perpendicular to the direction in which the plate extends. The bar may be provided to support only one of the first plate and the second plate or may be provided both the first plate and the second plate. For example, one surface of the bar may be provided to support a portion of the plate, and the other surface of the bar may be provided so as not to be in contact with the other portion of the plate. As another example, one surface of the bar may be provided to support at least a portion of the plate, and the other surface of the bar may be provided to support the other portion of the plate. The support may include a bar having an empty space therein or a plurality of bars, and an empty space are provided between the plurality of bars. In addition, the support may include a bar, and the bar may be disposed to provide an empty space between the bar and a separate component that is distinguished from the bar. The support may selectively include a connection plate 35 including a portion connected to the bar or a portion connecting the plurality of bars to each other. The connection plate may include a portion extending in the longitudinal direction of the vacuum space or a portion extending in the direction in which the plate extends. An XZ-plane cross-sectional area of the connection plate may be greater than an XZ-plane cross-sectional area of the bar. The connection plate may be provided on at least one of one surface and the other surface of the bar or may be provided between one surface and the other surface of the bar. At least one of one surface and the other surface of the bar may be a surface on which the bar supports the plate. The shape of the connection plate is not limited. The support may include a connection plate having an empty space therein or a plurality of connection plates, and an empty space are provided between the plurality of connection plates. In addition, the support may include a connection plate, and the connection plate may be disposed to provide an empty space between the connection plate and a separate component that is distinguished from the connection plate. As a second example, the support may include a support plate 35. The support plate may include a portion extending in the longitudinal direction of the vacuum space or a portion extending in the direction in which the plate extends. The support plate may be provided to support only one of the first plate and the second plate or may be provided both the first plate and the second plate. For example, one surface of the support plate may be provided to support a portion of the plate, and the other surface of the support plate may be provided so as not to be in contact with the other portion of the plate. As another example, one surface of the support plate may be provided to support at least a portion of the plate, and the other surface of the support plate may be provided to support the other portion of the plate. A cross-sectional shape of the support plate is not limited. The support may include a support plate having an empty space therein or a plurality of support plates, and an empty space are provided between the plurality of support plates. In addition, the support may include a support plate, and the support plate may be disposed to provide an empty space between the support plate and a separate component that is distinguished from the support plate. As a third example, the support may include a porous material 33 or a filler 33. The inside of the vacuum space may be supported by the porous material or the filler. The inside of the vacuum space may be completely filled by the porous material or the filler. The support may include a plurality of porous materials or a plurality of fillers, and the plurality of porous materials or the plurality of fillers may be disposed to be in contact with each other. When an empty space is provided inside the porous material, provided between the plurality of porous materials, or provided between the porous material and a separate component that is distinguished from the porous material, the porous material may be understood as including any one of the aforementioned bar, connection plate, and support plate. When an empty space is provided inside the filler, provided between the plurality of fillers, or provided between the filler and a separate component that is distinguished from the filler, the filler may be understood as including any one of the aforementioned bar, connection plate, and support plate. The support according to the present disclosure may include any one of the above examples or an example in which two or more examples are combined.

Referring to FIG. 3*a*, as an embodiment, the support may include a bar 31 and a connection plate and support plate 35. The connection plate and the supporting plate may be designed separately. Referring to FIG. 3*b*, as an embodiment, the support may include a bar 31, a connection plate and support plate 35, and a porous material 33 filled in the vacuum space. The porous material 33 may have emissivity greater than that of stainless steel, which is a material of the plate, but since the vacuum space is filled, resistance efficiency of radiant heat transfer is high. The porous material may also function as a heat transfer resistor to be described later. More preferably, the porous material may perform a function of a radiation resistance sheet to be described later.

Referring to FIG. 3*c*, as an embodiment, the support may include a porous material 33 or a filler 33. The porous material 33 and the filler may be provided in a compressed state to maintain a gap between the vacuum space. The film 34 may be provided in a state in which a hole is punched as, for example, a PE material. The porous material 33 or the filler may perform both a function of the heat transfer resistor and a function of the support, which will be described later. More preferably, the porous material may perform both a function of the radiation resistance sheet and a function of the support to be described later.

FIG. 4 is a view for explaining an example of the vacuum adiabatic body based on heat transfer resistors 32, 33, 60, and 63 (e.g., thermal insulator and a heat transfer resistance body). The vacuum adiabatic body according to the present disclosure may optionally include a heat transfer resistor. An example of the heat transfer resistor is as follows. The present disclosure may be any one of the following examples or a combination of two or more examples.

The heat transfer resistors 32, 33, 60, and 63 may be objects that reduce an amount of heat transfer between the first space and the second space or objects that reduce an amount of heat transfer between the first plate and the second plate. The heat transfer resistor may be disposed on a heat transfer path defined between the first space and the second space or be disposed on a heat transfer path formed between the first plate and the second plate. The heat transfer resistor may include a portion extending in a direction along a wall defining the vacuum space or a portion extending in a direction in which the plate extends. Optionally, the heat transfer resistor may include a portion extending from the plate in a direction away from the vacuum space. The heat transfer resistor may be provided on at least a portion of the periphery of the first plate or the periphery of the second plate or be provided on at least a portion of an edge of the first plate or an edge of the second plate. The heat transfer resistor may be provided at a portion, in which the through-hole is defined, or provided as a tube connected to the through-hole. A separate tube or a separate component that is distinguished from the tube may be disposed inside the tube. The heat transfer resistor may include a portion having heat transfer resistance greater than that of the plate. In this case, adiabatic performance of the vacuum adiabatic body may be further improved. A shield 62 may be provided on the outside of the heat transfer resistor to be insulated. The inside of the heat transfer resistor may be insulated by the vacuum space. The shield may be provided as a porous material or a filler that is in contact with the inside of the heat transfer resistor. The shield may be an adiabatic structure that is exemplified by a separate gasket placed outside the inside of the heat transfer resistor. The heat transfer resistor may be a wall defining the third space.

An example in which the heat transfer resistor is connected to the plate may be understood as replacing the support with the heat transfer resistor in an example in which the support is provided to support the plate. A duplicate description will be omitted. The example in which the heat transfer resistor is connected to the support may be understood as replacing the plate with the support in the example in which the heat transfer resistor is connected to the plate. A duplicate description will be omitted. The example of reducing heat transfer via the heat transfer body may be applied as a substitute the example of reducing the heat transfer via the support, and thus, the same explanation will be omitted.

In the present disclosure, the heat transfer resistor may be one of a radiation resistance sheet 32, a porous material 33, a filler 33, and a conductive resistance sheet. In the present disclosure, the heat transfer resistor may include a combination of at least two of the radiation resistance sheet 32, the porous material 33, the filler 33, and the conductive resistance sheet. As a first example, the heat transfer resistor may include a radiation resistance sheet 32. The radiation resistance sheet may include a portion having heat transfer resistance greater than that of the plate, and the heat transfer resistance may be a degree of resistance to heat transfer by radiation. The support may perform a function of the radiation resistance sheet together. A conductive resistance sheet to be described later may perform the function of the radiation resistance sheet together. As a second example, the heat transfer resistor may include conduction resistance sheets 60 and 63. The conductive resistance sheet may include a portion having heat transfer resistance greater than that of the plate, and the heat transfer resistance may be a degree of resistance to heat transfer by conduction. For example, the conductive resistance sheet may have a thickness less than that of at least a portion of the plate. As another example, the conductive resistance sheet may include one end and the other end, and a length of the conductive resistance sheet may be longer than a straight distance connecting one end of the conductive resistance sheet to the other end of the conductive resistance sheet. As another example, the conductive resistance sheet may include a material having resistance to heat transfer greater than that of the plate by conduction. As another example, the heat transfer resistor may include a portion having a curvature radius less than that of the plate.

Referring to FIG. 4*a*, for example, a conductive resistance sheet may be provided on a side plate connecting the first plate to the second plate. Referring to FIG. 4*b*, for example, a conductive resistance sheet 60 may be provided on at least a portion of the first plate and the second plate. A connection frame 70 may be further provided outside the conductive resistance sheet. The connection frame may be a portion from which the first plate or the second plate extends or a portion from which the side plate extends. Optionally, the connection frame 70 may include a portion at which a component for scaling the door and the body and a component disposed outside the vacuum space such as the exhaust port and the getter port, which are required for the exhaust process, are connected to each other. Referring to FIG. 4*c*, for example, a conductive resistance sheet may be provided on a side plate connecting the first plate to the second plate. The conductive resistance sheet may be installed in a through-hole passing through the vacuum space. The conduit 64 may be provided separately outside the conductive resistance sheet. The conductive resistance sheet may be provided in a pleated shape. Through this, the heat transfer path may be lengthened, and deformation due to a pressure difference may be prevented. A separate shielding member for insulating the conductive resistance sheet 63 may also be provided. The conductive resistance sheet may include a portion having a degree of deformation resistance less than that of at least one of the plate, the radiation resistance sheet, or the support. The radiation resistance sheet may include a portion having a degree of deformation resistance less than that of at least one of the plate or the support. The plate may include a portion having a degree of deformation resistance less than that of the support. The conductive resistance sheet may include a portion having conductive heat transfer resistance greater than that of at least one of the plate, the radiation resistance sheet, or the support. The radiation resistance sheet may include a portion having radiation heat transfer resistance greater than that of at least one of the plate, the conductive resistance sheet, or the support. The support may include a portion having heat transfer resistance greater than that of the plate. For example, at least one of the plate, the conductive resistance sheet, or the connection frame may include stainless steel material, the radiation resistance sheet may include aluminum, and the support may include a resin material.

FIG. 5 is a graph for observing a process of exhausting the inside of the vacuum adiabatic body with a time and pressure when the support is used. An example of a vacuum adiabatic body vacuum exhaust process vacuum is as follows. The present disclosure may be any one of the following examples or a combination of two or more examples.

While the exhaust process is being performed, an outgassing process, which is a process in which a gas of the vacuum space is discharged, or a potential gas remaining in the components of the vacuum adiabatic body is discharged, may be performed. As an example of the outgassing process, the exhaust process may include at least one of heating or drying the vacuum adiabatic body, providing a vacuum pressure to the vacuum adiabatic body, or providing a getter to the vacuum adiabatic body. In this case, it is possible to promote the vaporization and exhaust of the potential gas remaining in the component provided in the vacuum space. The exhaust process may include a process of cooling the vacuum adiabatic body. The cooling process may be performed after the process of heating or drying the vacuum adiabatic body is performed. The process of heating or drying the vacuum adiabatic body process of providing the vacuum pressure to the vacuum adiabatic body may be performed together. The process of heating or drying the vacuum adiabatic body and the process of providing the getter to the vacuum adiabatic body may be performed together. After the process of heating or drying the vacuum adiabatic body is performed, the process of cooling the vacuum adiabatic body may be performed. The process of providing the vacuum pressure to the vacuum adiabatic body and the process of providing the getter to the vacuum adiabatic body may be performed so as not to overlap each other. For example, after the process of providing the vacuum pressure to the vacuum adiabatic body is performed, the process of providing the getter to the vacuum adiabatic body may be performed. When the vacuum pressure is provided to the vacuum adiabatic body, a pressure of the vacuum space may drop to a certain level and then no longer drop. Here, after stopping the process of providing the vacuum pressure to the vacuum adiabatic body, the getter may be input. As an example of stopping the process of providing the vacuum pressure to the vacuum adiabatic body, an operation of a vacuum pump connected to the vacuum space may be stopped. When inputting the getter, the process of heating or drying the vacuum adiabatic body may be performed together. Through this, the outgassing may be promoted. As another example, after the process of providing the getter to the vacuum adiabatic body is performed, the process of providing the vacuum pressure to the vacuum adiabatic body may be performed.

The time during which the vacuum adiabatic body vacuum exhaust process is performed may be referred to as a vacuum exhaust time. The vacuum exhaust time includes at least one of a time Δ1 during which the process of heating or drying the vacuum adiabatic body is performed, a time Δt2 during which the process of maintaining the getter in the vacuum adiabatic body is performed, of a time Δt3 during which the process of cooling the vacuum adiabatic body is performed. Examples of times Δt1, Δt2, and Δt3 are as follows. The present disclosure may be any one of the following examples or a combination of two or more examples. In the vacuum adiabatic body vacuum exhaust process, the time Δt1 may be a time t1*a* or more and a time t1*b* or less. As a first example, the time t1*a* may be greater than or equal to about 0.2 hr and less than or equal to about 0.5 hr. The time t1*b* may be greater than or equal to about 1 hr and less than or equal to about 24.0 hr. The time Δt1 may be about 0.3 hr or more and about 12.0 hr or less. The time Δt1 may be about 0.4 hr or more and about 8.0 hr or less. The time Δt1 may be about 0.5 hr or more and about 4.0 hr or less. In this case, even if the Δt1 is kept as short as possible, the sufficient outgassing may be applied to the vacuum adiabatic body. For example, this case may include a case in which a component of the vacuum adiabatic body, which is exposed to the vacuum space, among the components of the vacuum adiabatic body, has an outgassing rate (%) less than that of any one of the component of the vacuum adiabatic body, which is exposed to the external space of the vacuum space. Specifically, the component exposed to the vacuum space may include a portion having a outgassing rate less than that of a thermoplastic polymer. More specifically, the support or the radiation resistance sheet may be disposed in the vacuum space, and the outgassing rate of the support may be less than that of the thermoplastic plastic. As another example, this case may include a case in which a component of the vacuum adiabatic body, which is exposed to the vacuum space, among the components of the vacuum adiabatic body, has a max operating temperature (° C.) greater than that of any one of the component of the vacuum adiabatic body, which is exposed to the external space of the vacuum space. In this case, the vacuum adiabatic body may be heated to a higher temperature to increase in outgassing rate. For example, the component exposed to the vacuum space may include a portion having an operating temperature greater than that of the thermoplastic polymer. As a more specific example, the support or the radiation resistance sheet may be disposed in the vacuum space, and a use temperature of the support may be higher than that of the thermoplastic plastic. As another example, among the components of the vacuum adiabatic body, the component exposed to the vacuum space may contain more metallic portion than a non-metallic portion. That is, a mass of the metallic portion may be greater than a mass of the non-metallic portion, a volume of the metallic portion may be greater than a volume of the non-metallic portion, or an area of the metallic portion exposed to the vacuum space may be greater than an area exposed to the non-metallic portion of the vacuum space. When the components exposed to the vacuum space are provided in plurality, the sum of the volume of the metal material included in the first component and the volume of the metal material included in the second component may be greater than that of the volume of the non-metal material included in the first component and the volume of the non-metal material included in the second component. When the components exposed to the vacuum space are provided in plurality, the sum of the mass of the metal material included in the first component and the mass of the metal material included in the second component may be greater than that of the mass of the non-metal material included in the first component and the mass of the non-metal material included in the second component. When the components exposed to the vacuum space are provided in plurality, the sum of the area of the metal material, which is exposed to the vacuum space and included in the first component, and an area of the metal material, which is exposed to the vacuum space and included in the second component, may be greater than that of the area of the non-metal material, which is exposed to the vacuum space and included in the first component, and an area of the non-metal material, which is exposed to the vacuum space and included in the second component. As a second example, the time t1*a* may be greater than or equal to about 0.5 hr and less than or equal to about 1 hr. The time t1*b* may be greater than or equal to about 24.0 hr and less than or equal to about 65 hr. The time Δt1 may be about 1.0 hr or more and about 48.0 hr or less. The time Δt1 may be about 2 hr or more and about 24.0 hr or less. The time Δt1 may be about 3 hr or more and about 12.0 hr or less. In this case, it may be the vacuum adiabatic body that needs to maintain the Δt1 as long as possible. In this case, a case opposite to the examples described in the first example or a case in which the component exposed to the vacuum space is made of a thermoplastic material may be an example. A duplicated description will be omitted. In the vacuum adiabatic body vacuum exhaust process, the time Δt1 may be a time t1*a* or more and a time t1*b* or less. The time t2*a* may be greater than or equal to about 0.1 hr and less than or equal to about 0.3 hr. The time t2*b* may be greater than or equal to about 1 hr and less than or equal to about 5.0 hr. The time Δt2 may be about 0.2 hr or more and about 3.0 hr or less. The time Δt2 may be about 0.3 hr or more and about 2.0 hr or less. The time Δt2 may be about 0.5 hr or more and about 1.5 hr or less. In this case, even if the time Δt2 is kept as short as possible, the sufficient outgassing through the getter may be applied to the vacuum adiabatic body. In the vacuum adiabatic body vacuum exhaust process, the time Δt3 may be a time t3*a* or more and a time t3*b* or less. The time t2*a* may be greater than or equal to about 0.2 hr and less than or equal to about 0.8 hr. The time t2*b* may be greater than or equal to about 1 hr and less than or equal to about 65.0 hr. The tine Δt3 may be about 0.2 hr or more and about 48.0 hr or less. The time Δt3 may be about 0.3 hr or more and about 24.0 hr or less. The time Δt3 may be about 0.4 hr or more and about 12.0 hr or less. The time Δt3 may be about 0.5 hr or more and about 5.0 hr or less. After the heating or drying process is performed during the exhaust process, the cooling process may be performed. For example, when the heating or drying process is performed for a long time, the time Δt3 may be long. The vacuum adiabatic body according to the present disclosure may be manufactured so that the time Δt1 is greater than the time Δt2, the time Δt1 is less than or equal to the time Δt3, or the time Δt3 is greater than the time Δt2. The following relational expression is satisfied: $\Delta t2<\Delta t1\leq\Delta t3$. The vacuum adiabatic body according to an embodiment may be manufactured so that the relational expression: $\Delta t1+\Delta t2+\Delta t3$ may be greater than or equal to about 0.3 hr and less than or equal to about 70 hr, be greater than or equal to about 1 hr and less than or equal to about 65 hr, or be greater than or equal to about 2 hr and less than or equal to about 24 hr. The relational expression: $\Delta t1+\Delta t2+\Delta t3$ may be manufactured to be greater than or equal to about 3 hr and less than or equal to about 6 hr.

An example of the vacuum pressure condition during the exhaust process is as follows. The present disclosure may be any one of the following examples or a combination of two or more examples. A minimum value of the vacuum pressure in the vacuum space during the exhaust process may be greater than about 1.8E-6 Torr. The minimum value of the vacuum pressure may be greater than about 1.8E-6 Torr and less than or equal to about 1.0E-4 Torr, be greater than about 0.5E-6 Torr and less than or equal to about 1.0E-4 Torr, or be greater than about 0.5E-6 Torr and less than or equal to about 0.5E-5 Torr. The minimum value of the vacuum pressure may be greater than about 0.5E-6 Torr and less than about 1.0E-5 Torr. As such, the limitation in which the minimum value of the vacuum pressure provided during the exhaust process is because, even if the pressure is reduced through the vacuum pump during the exhaust process, the decrease in vacuum pressure is slowed below a certain level. As an embodiment, after the exhaust process is performed, the vacuum pressure of the vacuum space may be maintained at a pressure greater than or equal to about 1.0E-5 Torr and less than or equal to about 5.0E-1 Torr. The maintained vacuum pressure may be greater than or equal to about 1.0E-5 Torr and less than or equal to about 1.0E-1 Torr, be greater than or equal to about 1.0E-5 Torr and less than or equal to about 1.0E-2 Torr, be greater than or equal to about 1.0E-4 Torr and less than or equal to about 1.0E-2 Torr, or be greater than or equal to about 1.0E-5 Torr and less than or equal to about 1.0E-3 Torr. As a result of predicting the change in vacuum pressure with an accelerated experiment of two example products, one product may be provided so that the vacuum pressure is maintained below about 1.0E-04 Torr even after about 16.3 years, and the other product may be provided so that the vacuum pressure is maintained below about 1.0E-04 Torr even after about 17.8 years. As described above, the vacuum pressure of the vacuum adiabatic body may be used industrially only when it is maintained below a predetermined level even if there is a change over time.

FIG. 5*a* is a graph of an elapsing time and pressure in the exhaust process according to an example, and FIG. 5*b* is a view explaining results of a vacuum maintenance test in the acceleration experiment of the vacuum adiabatic body of the refrigerator having an internal volume of about 128 liters. Referring to FIG. 5*b*, it is seen that the vacuum pressure gradually increases according to the aging. For example, it is confirmed that the vacuum pressure is about 6.7E-04 Torr after about 4.7 years, about 1.7E-03 Torr after about 10 years, and about 1.0E-02 Torr after about 59 years. According to these experimental results, it is confirmed that the vacuum adiabatic body according to the embodiment is sufficiently industrially applicable.

FIG. 6 is a graph illustrating results obtained by comparing the vacuum pressure with gas conductivity. Referring to FIG. 6, gas conductivity with respect to the vacuum pressure depending on a size of the gap in the vacuum space 50 was represented as a graph of effective heat transfer coefficient (eK). The effective heat transfer coefficient (eK) was measured when the gap in the vacuum space 50 has three values of about 3 mm, about 4.5 mm, and about 9 mm. The gap in the vacuum space 50 is defined as follows. When the radiation resistance sheet 32 exists inside surface vacuum space 50, the gap is a distance between the radiation resistance sheet 32 and the plate adjacent thereto. When the radiation resistance sheet 32 does not exist inside surface vacuum space 50, the gap is a distance between the first and second plates. It was seen that, since the size of the gap is small at a point corresponding to a typical effective heat transfer coefficient of about 0.0196 W/mK, which is provided to an adiabatic material formed by foaming polyurethane, the vacuum pressure is about 5.0E-1 Torr even when the size of the gap is about 3 mm. Meanwhile, it was seen that the point at which reduction in adiabatic effect caused by the gas conduction heat is saturated even though the vacuum pressure decreases is a point at which the vacuum pressure is approximately 4.5E-3 Torr. The vacuum pressure of about 4.5E-3 Torr may be defined as the point at which the reduction in adiabatic effect caused by the gas conduction heat is saturated. Also, when the effective heat transfer coefficient is about 0.01 W/mK, the vacuum pressure is about 1.2E-2 Torr. An example of a range of the vacuum pressure in the vacuum space according to the gap is presented. The support may include at least one of a bar, a connection plate, or a support plate. In this case, when the gap of the vacuum space is greater than or equal to about 3 mm, the vacuum pressure may be greater than or equal to A and less than about 5E-1 Torr, or be greater than about 2.65E-1 Torr and less than about 5E-1 Torr. As another example, the support may include at least one of a bar, a connection plate, or a support plate. In this case, when the gap of the vacuum space is greater than or equal to about 4.5 mm, the vacuum pressure may be greater than or equal to A and less than about 3E-1 Torr, or be greater than about 1.2E-2 Torr and less than about 5E-1 Torr. As another example, the support may include at least one of a bar, a connection plate, or a support plate, and when the gap of the vacuum space is greater than or equal to about 9 mm, the vacuum pressure may be greater than or equal to A and less than about 1.0×10^−1 Torr or be greater than about 4.5E-3 Torr and less than about 5E-1 Torr. Here, the A may be greater than or equal to about 1.0×10^−1 Torr and less than or equal to about 1.0E-5 Torr. The A may be greater than or equal to about 1.0×10^−5 Torr and less than or equal to about 1.0E-4 Torr. When the support includes a porous material or a filler, the vacuum pressure may be greater than or equal to about 4.7E-2 Torr and less than or equal to about 5E-1 Torr. In this case, it is understood that the size of the gap ranges from several micrometers to several hundreds of micrometers. When the support and the porous material are provided together in the vacuum space, a vacuum pressure may be created and used, which is middle between the vacuum pressure when only the support is used and the vacuum pressure when only the porous material is used.

FIG. 7 is a view illustrating various examples of the vacuum space. The present disclosure may be any one of the following examples or a combination of two or more examples.

Referring to FIG. 7, the vacuum adiabatic body according to the present disclosure may include a vacuum space. The vacuum space 50 may include a first vacuum space extending in a first direction (e.g., X-axis) and having a predetermined height. The vacuum space 50 may optionally include a second vacuum space (hereinafter, referred to as a vacuum space expansion portion) different from the first vacuum space in at least one of the height or the direction. The vacuum space expansion portion may be provided by allowing at least one of the first and second plates or the side plate to extend. In this case, the heat transfer resistance may increase by lengthening a heat conduction path along the plate. The vacuum space expansion portion in which the second plate extends may reinforce adiabatic performance of a front portion of the vacuum adiabatic body. The vacuum space expansion portion in which the second plate extends may reinforce adiabatic performance of a rear portion of the vacuum adiabatic body, and the vacuum space expansion portion in which the side plate extends may reinforce adiabatic performance of a side portion of the vacuum adiabatic body. Referring to FIG. 7*a*, the second plate may extend to provide the vacuum space expansion portion 51. The second plate may include a second portion 202 extending from a first portion 201 defining the vacuum space 50 and the vacuum space expansion portion 51. The second portion 202 of the second plate may branch a heat conduction path along the second plate to increase in heat transfer resistance. Referring to FIG. 7*b*, the side plate may extend to provide the vacuum space expansion portion. The side plate may include a second portion 152 extending from a first portion 151 defining the vacuum space 50 and the vacuum space extension portion 51. The second portion of the side plate may branch the heat conduction path along the side plate to improve the adiabatic performance. The first and second portions 151 and 152 of the side plate may branch the heat conduction path to increase in heat transfer resistance. Referring to FIG. 7*c*, the first plate may extend to provide the vacuum space expansion portion. The first plate may include a second portion 102 extending from the first portion 101 defining the vacuum space 50 and the vacuum space expansion portion 51. The second portion of the first plate may branch the heat conduction path along the second plate to increase in heat transfer resistance. Referring to FIG. 7*d*, the vacuum space expansion portion 51 may include an X-direction expansion portion 51*a* and a Y-direction expansion portion 51*b* of the vacuum space. The vacuum space expansion portion 51 may extend in a plurality of directions of the vacuum space 50. Thus, the adiabatic performance may be reinforced in multiple directions and may increase by lengthening the heat conduction path in the plurality of directions to improve the heat transfer resistance. The vacuum space expansion portion extending in the plurality of directions may further improve the adiabatic performance by branching the heat conduction path. Referring to FIG. 7*e*, the side plate may provide the vacuum space extension portion extending in the plurality of directions. The vacuum space expansion portion may reinforce the adiabatic performance of the side portion of the vacuum adiabatic body. Referring to FIG. 7*f*, the first plate may provide the vacuum space extension portion extending in the plurality of directions. The vacuum space expansion portion may reinforce the adiabatic performance of the side portion of the vacuum adiabatic body.

Figure 8:
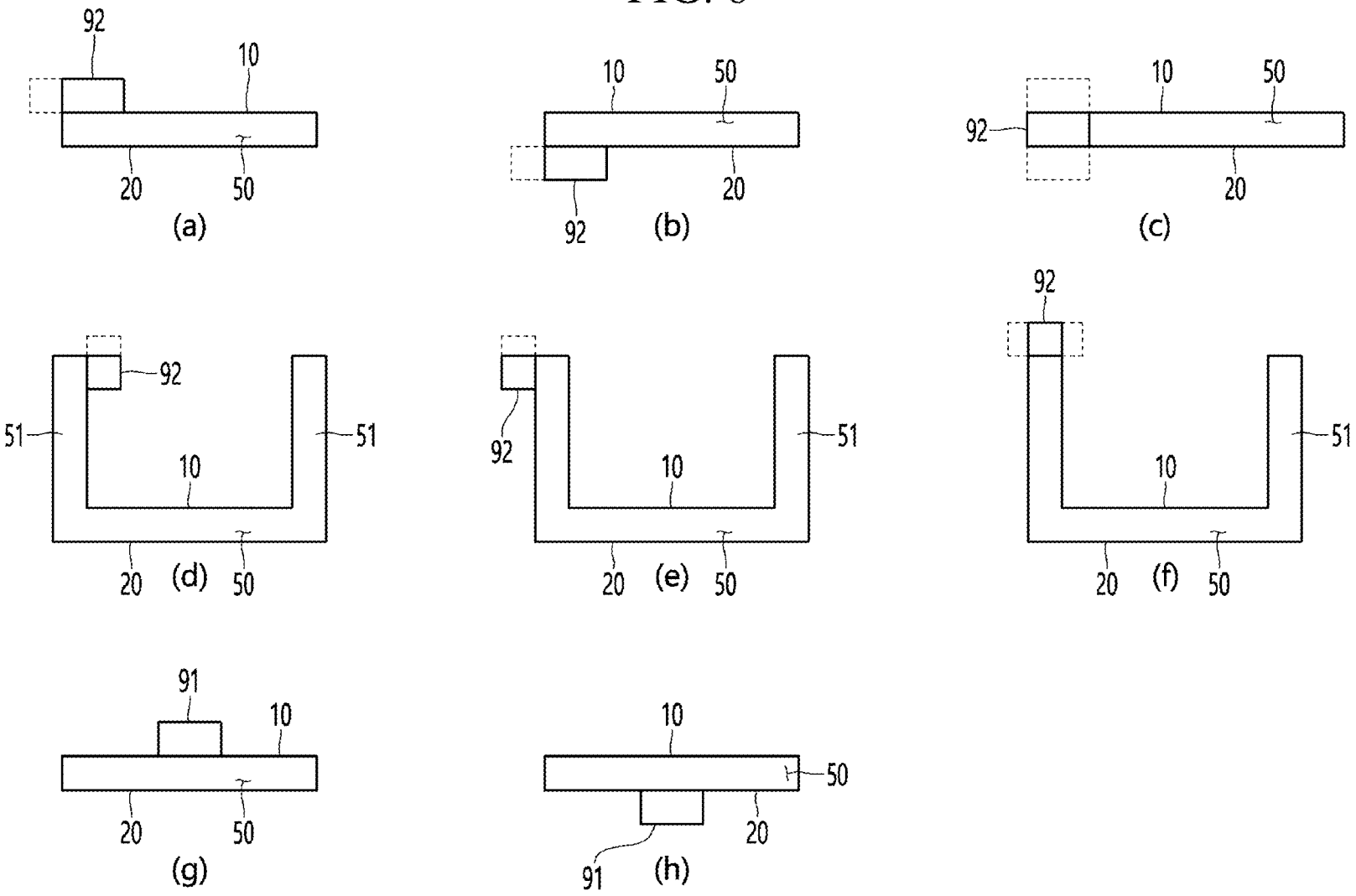
FIG. 8 is a view for explaining an additional adiabatic body.

FIG. 8 is a view for explaining another adiabatic body. The present disclosure may be any one of the following examples or a combination of two or more examples. Referring to FIG. 8, the vacuum adiabatic body according to the present disclosure may optionally include another adiabatic body 90. Another adiabatic body may have a degree of vacuum less than that of the vacuum adiabatic body and be an object that does not include a portion having a vacuum state therein. The vacuum adiabatic body and another vacuum adiabatic body may be directly connected to each other or connected to each other through an intermedium. In this case, the intermedium may have a degree of vacuum less than that of at least one of the vacuum adiabatic body or another adiabatic body or may be an object that does not include a portion having the vacuum state therein. When the vacuum adiabatic body includes a portion in which the height of the vacuum adiabatic body is high and a portion in which the height of the vacuum adiabatic body is low, another adiabatic body may be disposed at a portion having the low height of the vacuum adiabatic body. Another adiabatic body may include a portion connected to at least a portion of the first and second plates and the side plate. Another adiabatic body may be supported on the plate or coupled or sealed. A degree of sealing between another adiabatic body and the plate may be lower than a degree of sealing between the plates. Another adiabatic body may include a cured adiabatic body (e.g., PU foaming solution) that is cured after being injected, a premolded resin, a peripheral adiabatic body, and a side panel. At least a portion of the plate may be provided to be disposed inside another adiabatic body. Another adiabatic body may include an empty space. The plate may be provided to be accommodated in the empty space. At least a portion of the plate may be provided to cover at least a portion of another adiabatic body. Another adiabatic body may include a member covering an outer surface thereof. The member may be at least a portion of the plate. Another adiabatic body may be an intermedium for connecting, supporting, bonding, or scaling the vacuum adiabatic body to the component. Another adiabatic body may be an intermedium for connecting, supporting, bonding, or sealing the vacuum adiabatic body to another vacuum adiabatic body. Another adiabatic body may include a portion connected to a component coupling portion provided on at least a portion of the plate. Another adiabatic body may include a portion connected to a cover covering another adiabatic body. The cover may be disposed between the first plate and the first space, between the second plate and the second space, or between the side plate and a space other than the vacuum space 50. For example, the cover may include a portion on which the component is mounted. As another example, the cover may include a portion that defines an outer appearance of another adiabatic body. Referring to FIGS. 8*a* to 8*f*, another adiabatic body may include a peripheral adiabatic body. The peripheral adiabatic body may be disposed on at least a portion of a periphery of the vacuum adiabatic body, a periphery of the first plate, a periphery of the second plate, and the side plate. The peripheral adiabatic body disposed on the periphery of the first plate or the periphery of the second plate may extend to a portion at which the side plate is disposed or may extend to the outside of the side plate. The peripheral adiabatic body disposed on the side plate may extend to a portion at which the first plate or may extend to the outside of the first plate or the second plate. Referring to FIGS. 8*g* to 8*h*, another adiabatic body may include a central adiabatic body. The central adiabatic body may be disposed on at least a portion of a central portion of the vacuum adiabatic body, a central portion of the first plate, or a central portion of the second plate.

Referring to FIG. 8*a*, the peripheral adiabatic body 92 may be placed on the periphery of the first plate. The peripheral adiabatic body may be in contact with the first plate. The peripheral adiabatic body may be separated from the first plate or further extend from the first plate (indicated by dotted lines). The peripheral adiabatic body may improve the adiabatic performance of the periphery of the first plate. Referring to FIG. 8*b*, the peripheral adiabatic body may be placed on the periphery of the second plate. The peripheral adiabatic body may be in contact with the second plate. The peripheral adiabatic body may be separated from the second plate or further extend from the second plate (indicated by dotted lines). The periphery adiabatic body may improve the adiabatic performance of the periphery of the second plate. Referring to FIG. 8*c*, the peripheral adiabatic body may be disposed on the periphery of the side plate. The peripheral adiabatic body may be in contact with the side plate. The peripheral adiabatic body may be separated from the side plate or further extend from the side plate. The peripheral adiabatic body may improve the adiabatic performance of the periphery of the side plate Referring to FIG. 8*d*, the peripheral adiabatic body 92 may be disposed on the periphery of the first plate. The peripheral adiabatic body may be placed on the periphery of the first plate constituting the vacuum space expansion portion 51. The peripheral adiabatic body may be in contact with the first plate constituting the vacuum space extension portion. The peripheral adiabatic body may be separated from or further extend to the first plate constituting the vacuum space extension portion. The peripheral adiabatic body may improve the adiabatic performance of the periphery of the first plate constituting the vacuum space expansion portion. Referring to FIGS. 8*c* and 8*f*, in the peripheral adiabatic body, the vacuum space extension portion may be disposed on a periphery of the second plate or the side plate. The same explanation as in FIG. 8*d* may be applied. Referring to FIG. 8*g*, the central adiabatic body 91 may be placed on a central portion of the first plate. The central adiabatic body may improve adiabatic performance of the central portion of the first plate. Referring to FIG. 8*h*, the central adiabatic body may be disposed on the central portion of the second plate. The central adiabatic body may improve adiabatic performance of the central portion of the second plate.

Figure 9:
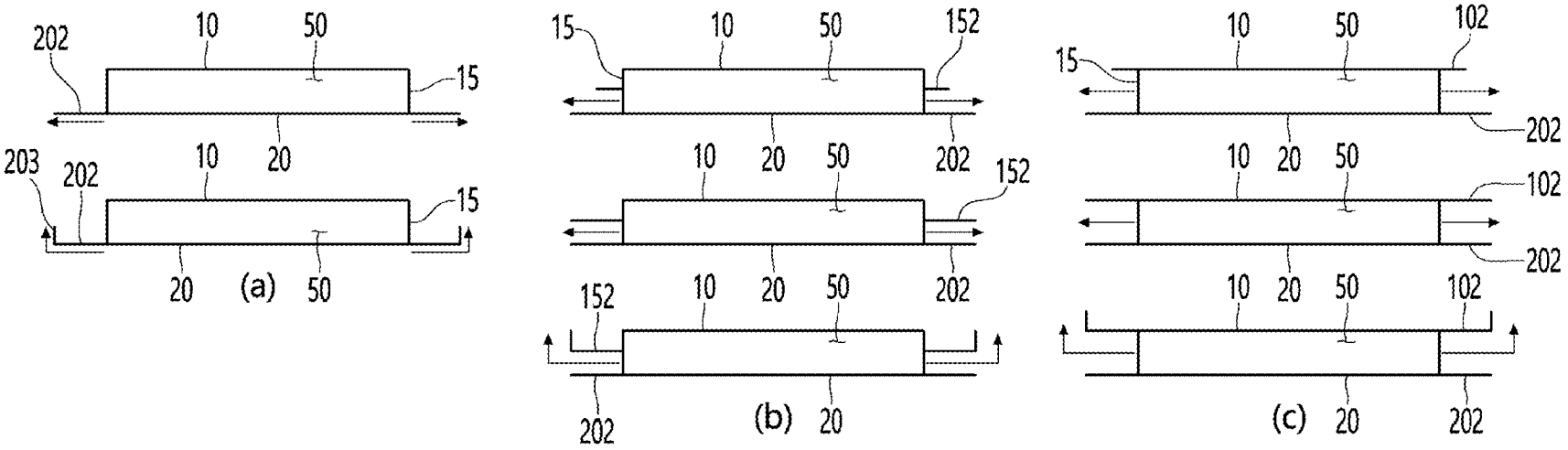
FIG. 9 is a view for explaining a heat transfer path between first and second plates having different temperatures.

FIG. 9 is a view for explaining a heat transfer path between first and second plates having different temperatures. An example of the heat transfer path is as follows. The present disclosure may be any one of the following examples or a combination of two or more examples.

The heat transfer path may pass through the extension portion at at least a portion of the first portion 101 of the first plate, the first portion 201 of the second plate, or the first portion 151 of the side plate. The first portion may include a portion defining the vacuum space. The extension portions 102, 152, and 202 may include portions extending in a direction away from the first portion. The extension portion may include a side portion of the vacuum adiabatic body, a side portion of the plate having a higher temperature among the first and second plates, or a portion extending toward the side portion of the vacuum space 50. The extension portion may include a front portion of the vacuum adiabatic body, a front portion of the plate having a higher temperature among the first and second plates, or a front portion extending in a direction away from the front portion of the vacuum space 50. Through this, it is possible to reduce generation of dew on the front portion. The vacuum adiabatic body or the vacuum space 50 may include first and second surfaces having different temperatures from each other. The temperature of the first surface may be lower than that of the second surface. For example, the first surface may be the first plate, and the second surface may be the second plate. The extension portion may extend in a direction away from the second surface or include a portion extending toward the first surface. The extension portion may include a portion, which is in contact with the second surface, or a portion extending in a state of being in contact with the second surface. The extension portion may include a portion extending to be spaced apart from the two surfaces. The extension portion may include a portion having heat transfer resistance greater than that of at least a portion of the plate or the first surface. The extension portion may include a plurality of portions extending in different directions. For example, the extension portion may include a second portion 202 of the second plate and a third portion 203 of the second plate. The third portion may also be provided on the first plate or the side plate. Through this, it is possible to increase in heat transfer resistance by lengthening the heat transfer path. In the extension portion, the above-described heat transfer resistor may be disposed. Another adiabatic body may be disposed outside the extending portion. Through this, the extension portion may reduce generation of dew on the second surface. Referring to FIG. 9*a*, the second plate may include the extension portion extending to the periphery of the second plate. Here, the extension portion may further include a portion extending backward. Referring to FIG. 9*b*, the side plate may include the extension portion extending to a periphery of the side plate. Here, the extension portion may be provided to have a length that is less than or equal to that of the extension portion of the second plate. Here, the extension portion may further include a portion extending backward. Referring to FIG. 9*c*, the first plate may include the extension portion extending to the periphery of the first plate. Here, the extension portion may extend to a length that is less than or equal to that of the extension portion of the second plate. Here, the extension portion may further include a portion extending backward.

Figure 10:
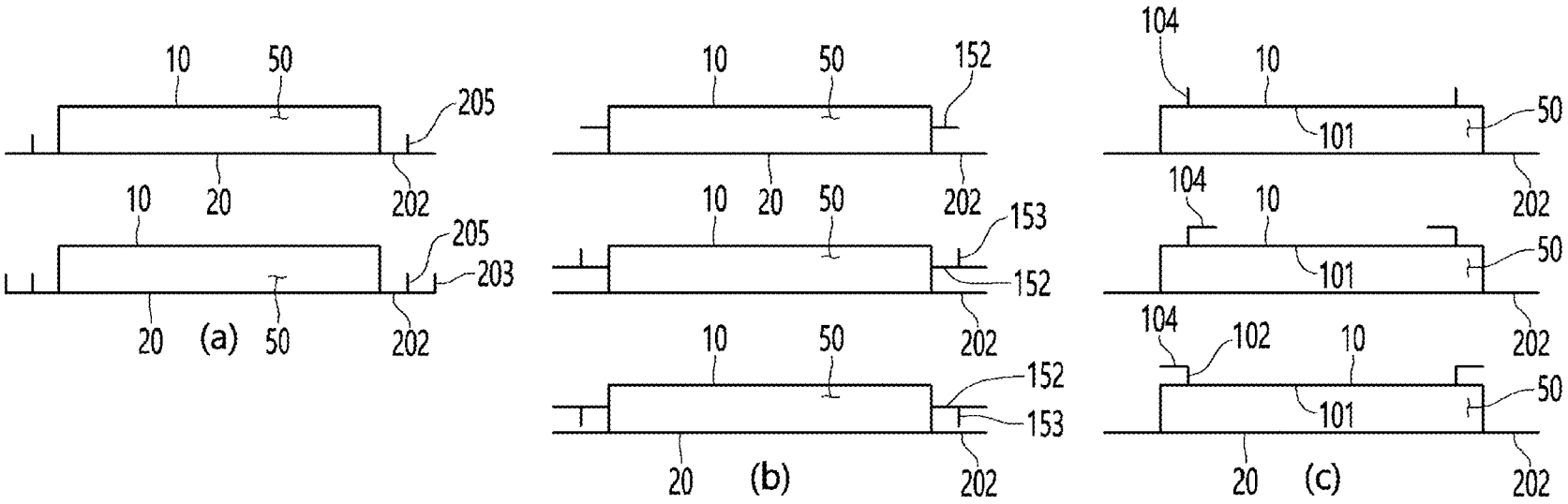
FIG. 10 is a view for explaining a branch on a heat transfer path between first and second plates having different temperatures.

FIG. 10 is a view for explaining a branch portion on the heat transfer path between first and second plates having different temperatures. An example of the branch portion is as follows. The present disclosure may be any one of the following examples or a combination of two or more examples.

Optionally, the heat transfer path may pass through portions 205, 153, and 104, each of which is branched from at least a portion of the first plate, the second plate, or the side plate. Here, the branched heat transfer path means a heat transfer path through which heat flows to be separated in a different direction from the heat transfer path through which heat flows along the plate. The branched portion may be disposed in a direction away from the vacuum space 50. The branched portion may be disposed in a direction toward the inside of the vacuum space 50. The branched portion may perform the same function as the extension portion described with reference to FIG. 9, and thus, a description of the same portion will be omitted. Referring to FIG. 10*a*, the second plate may include the branched portion 205. The branched portion may be provided in plurality, which are spaced apart from each other. The branched portion may include a third portion 203 of the second plate. Referring to FIG. 10*b*, the side plate may include the branched portion 153. The branched portion 153 may be branched from the second portion 152 of the side plate. The branched portion 153 may provide at least two. At least two branched portions 153 spaced apart from each other may be provided on the second portion 152 of the side plate. Referring to FIG. 10*c*, the first plate may include the branched portion 104. The branched portion may further extend from the second portion 102 of the first plate. The branched portion may extend toward the periphery. The branched portion 104 may be bent to further extend. A direction in which the branched portion extends in FIGS. 10*a*, 10*b*, and 10*c* may be the same as at least one of the extension directions of the extension portion described in FIG. 10.

Figure 11:
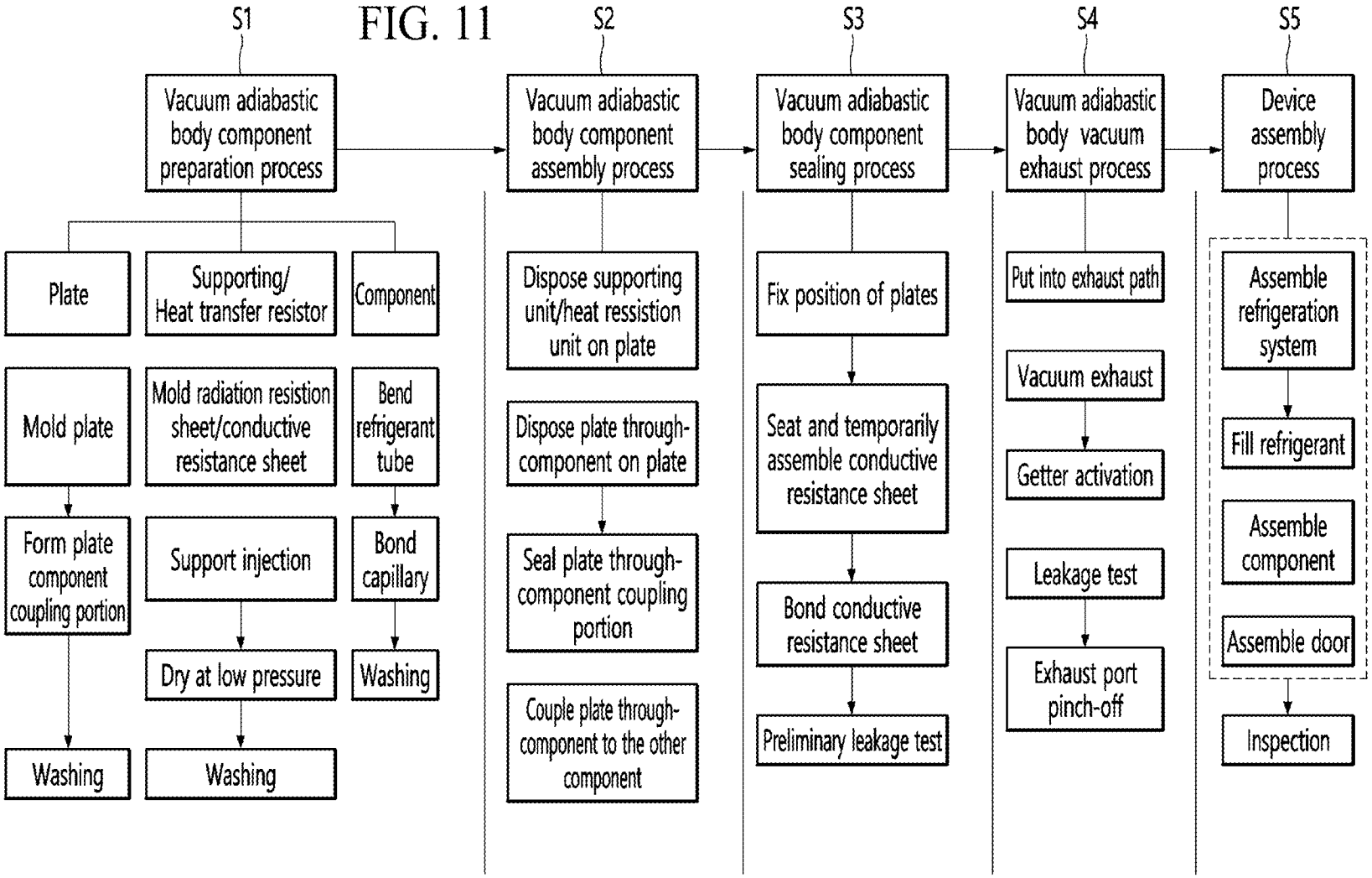
FIG. 11 is a view for explaining a method for manufacturing a vacuum adiabatic body.

FIG. 11 is a view for explaining a process of manufacturing the vacuum adiabatic body.

Optionally, the vacuum adiabatic body may be manufactured by a vacuum adiabatic body component preparation process in which the first plate and the second plate are prepared in advance. Optionally, the vacuum adiabatic body may be manufactured by a vacuum adiabatic body component assembly process in which the first plate and the second plate are assembled. Optionally, the vacuum adiabatic body may be manufactured by a vacuum adiabatic body vacuum exhaust process in which a gas in the space defined between the first plate and the second plate is discharged. Optionally, after the vacuum adiabatic body component preparation process is performed, the vacuum adiabatic body component assembly process or the vacuum adiabatic body exhaust process may be performed. Optionally, after the vacuum adiabatic body component assembly process is performed, the vacuum adiabatic body vacuum exhaust process may be performed. Optionally, the vacuum adiabatic body may be manufactured by the vacuum adiabatic body component scaling process (S3) in which the space between the first plate and the second plate is sealed. The vacuum adiabatic body component sealing process may be performed before the vacuum adiabatic body vacuum exhaust process (S4).

The vacuum adiabatic body may be manufactured as an object with a specific purpose by an apparatus assembly process (S5) in which the vacuum adiabatic body is combined with the components constituting the apparatus. The apparatus assembly process may be performed after the vacuum adiabatic body vacuum exhaust process. Here, the components constituting the apparatus means components constituting the apparatus together with the vacuum adiabatic body.

The vacuum adiabatic body component preparation process (S1) is a process in which components constituting the vacuum adiabatic body are prepared or manufactured. Examples of the components constituting the vacuum adiabatic body may include various components such as a plate, a support, a heat transfer resistor, and a tube. The vacuum adiabatic body component assembly process (S2) is a process in which the prepared components are assembled. The vacuum adiabatic body component assembly process may include a process of disposing at least a portion of the support and the heat transfer resistor on at least a portion of the plate. For example, the vacuum adiabatic body component assembly process may include a process of disposing at least a portion of the support and the heat transfer resistor between the first plate and the second plate. Optionally, the vacuum adiabatic body component assembly process may include a process of disposing a penetration component on at least a portion of the plate. For example, the vacuum adiabatic body component assembly process may include a process of disposing the penetration component or a surface component between the first and second plates. After the penetration component may be disposed between the first plate and the second plate, the penetration component may be connected or sealed to the penetration component coupling portion.

An example of a vacuum adiabatic body vacuum exhaust process vacuum is as follows. The present disclosure may be any one of the, examples or a combination of two or more examples. The vacuum adiabatic body vacuum exhaust process may include at least one of a process of inputting the vacuum adiabatic body into an exhaust passage, a getter activation process, a process of checking vacuum leakage and a process of closing the exhaust port. The process of forming the coupling part may be performed in at least one of the vacuum adiabatic body component preparation process, the vacuum adiabatic body component assembly process, or the apparatus assembly process. Before the vacuum adiabatic body exhaust process is performed, a process of washing the components constituting the vacuum adiabatic body may be performed. Optionally, the washing process may include a process of applying ultrasonic waves to the components constituting the vacuum adiabatic body or a process of providing ethanol or a material containing ethanol to surfaces of the components constituting the vacuum adiabatic body. The ultrasonic wave may have an intensity between about 10 kHz and about 50 kHz. A content of ethanol in the material may be about 50% or more. For example, the content of ethanol in the material may range of about 50% to about 90%. As another example, the content of ethanol in the material may range of about 60% to about 80%. As another example, the content of ethanol in the material may be range of about 65% to about 75%. Optionally, after the washing process is performed, a process of drying the components constituting the vacuum adiabatic body may be performed. Optionally, after the washing process is performed, a process of heating the components constituting the vacuum adiabatic body may be performed.

The contents described in FIGS. 1 to 11 may be applied to all or selectively applied to the embodiments described with reference to the drawings below.

As an embodiment, an example of a process associated with a plate is as follows. Any one or two or more examples among following examples of the present disclosure will be described. The vacuum adiabatic body component preparation process may include a process of manufacturing the plate. Before the vacuum adiabatic body vacuum exhaust process is performed, the process of manufacturing the plate may be performed. Optionally, the plate may be manufactured by a metal sheet. For example, a thin and wide plate may be manufactured using plastic deformation. Optionally, the manufacturing process may include a process of molding the plate. The molding process may be applied to the molding of the side plate or may be applied to a process of integrally manufacturing at least a portion of at least one of the first plate and the second plate, and the side plate. For example, the molding may include drawing. The molding process may include a process in which the plate is partially seated on a support. The molding process may include a process of partially applying force to the plate. The molding process may include a process of seating a portion of the plate on the support a process of applying force to the other portion of the plate. The molding process may include a process of deforming the plate. The deforming process may include a process of forming at least one or more curved portions on the plate. The deforming process may include a process of changing a curvature radius of the plate or a process of changing a thickness of the plate. As a first example, the process of changing the thickness may include a process of allowing a portion of the plate to increase in thickness, and the portion may include a portion extending in a longitudinal direction of the internal space (a first straight portion). The portion may be provided in the vicinity of the portion at which the plate is seated on the support in the process of molding the plate. As a second example, the process of changing the thickness may include a process of reducing a thickness of a portion of the plate, and the portion may include a portion extending in a longitudinal direction of the internal space (a second straight portion). The portion may be provided in the vicinity of a portion to which force is applied to the plate in the process of molding the plate. As a third example, the process of changing the thickness may include a process of reducing a thickness of a portion of the plate, and the portion may include a portion extending in a height direction of the internal space (the second straight portion). The portion may be connected to the portion extending in the longitudinal direction of the internal space of the plate. As a fourth example, the process of changing the thickness may include a process of allowing a portion of the plate to increase in thickness, and the portion may include at least one of a portion to which the side plate extends in the longitudinal direction of the internal space and a curved portion provided between the portions extending in the height direction of the internal space (a first curved portion). The curved portion may be provided at the portion seated on the support of the plate or in the vicinity of the portion in the process of molding the plate. As a fifth example, the process of changing the thickness may include a process of allowing a portion of the plate to decrease in thickness, and the portion may include at least one of a portion to which the side plate extends in the longitudinal direction of the internal space and a curved portion provided between the portions extending in the height direction of the internal space (a second curved portion). The curved portion may be provided in the vicinity of a portion to which force is applied to the plate in the process of molding the plate. The deforming process may be any one of the above-described examples or an example in which at least two of the above-described examples are combined.

The process associated with the plate may selectively include a process of washing the plate. An example of a process sequence associated with the process of washing the plate is as follows. The present disclosure may be any one of the following examples or a combination of two or more examples. Before the vacuum adiabatic body vacuum exhaust process is performed, the process of washing the plate may be performed. After the process of manufacturing the plate is performed, at least one of the process of molding the plate and the process of washing the plate may be performed. After the process of molding the plate is performed, the process of washing the plate may be performed. Before the process of molding the plate is performed, the process of washing the plate may be performed. After the process of manufacturing the plate is performed, at least one of a process of providing a component coupling portion to a portion of the plate or the process of washing the plate may be performed. After the process of providing the component coupling portion to a portion of the plate is performed, the process of washing the plate may be performed.

The process associated with the plate selectively include the process of providing the component coupling portion to the plate. An example of a process sequence associated with the process of providing the component coupling portion to the plate is as follows. The present disclosure may be any one of the following examples or a combination of two or more examples. Before the vacuum adiabatic body vacuum exhaust process is performed, a process of providing the component coupling portion to a portion of the plate may be performed. For example, the process of providing the component coupling portion may include a process of manufacturing a tube provided to the component coupling portion. The tube may be connected to a portion of the plate. The tube may be disposed in an empty space provided in the plate or in an empty space provided between the plates. As another example, the process of providing the component coupling portion may include a process of providing a through-hole in a portion of the plate. For another example, the process of providing the component coupling portion may include a process of providing a curved portion to at least one of the plate or the tube.

The process associated with the plate may optionally include a process for scaling the vacuum adiabatic body component associated with the plate. An example of a process sequence associated with the process of sealing the vacuum adiabatic body component associated with the plate is as follows. The present disclosure may be any one of the following examples or a combination of two or more examples. After the process of providing the through-hole in the portion of the plate is performed, at least one of a process of providing a curved portion to at least a portion of the plate or the tube or a process of providing a seal between the plate and the tube may be performed. After the process of providing the curved portion to at least a portion of at least one of the plate or the tube is performed, the process of sealing the gap between the plate and the tube may be performed. The process of providing the through-hole in the portion of the plate and the process of providing the curved portion in at least a portion of the plate and the tube may be performed at the same time. The process of providing a through-hole in a part of the plate and the process of providing the seal between the plate and the tube may be performed at the same time. After the process of providing the curved portion to the tube is performed, the process of providing a through-hole in the portion of the plate may be performed. Before the vacuum adiabatic body vacuum exhaust process is performed, a portion of the tube may be provided and/or sealed to the plate, and after the vacuum adiabatic body vacuum exhaust process is performed, the other portion of the tube may be scaled.

When at least a portion of the plate is used to be integrated with a heat transfer resistor, the example of the process associated with the plate may also be applied to the example of the process of the heat transfer resistor.

Optionally, the vacuum adiabatic body may include a side plate connecting the first plate to the second plate. Examples of the side plate are as follows. The present disclosure may be any one of the following examples or a combination of two or more examples. The side plate may be provided to be integrated with at least one of the first or second plate. The side plate may be provided to be integrated with any one of the first and second plates. The side plate may be provided as any one of the first and second plates. The side plate may be provided as a portion of any one of the first and second plates. The side plate may be provided as a component separated from the other of the first and second plates. In this case, optionally, the side plate may be provided to be coupled or sealed to the other one of the first and second plates. The side plate may include a portion having a degree of strain resistance, which is greater than that of at least a portion of the other one of the first and second plates. The side plate may include a portion having a thickness greater than that of at least a portion of the other one of the first and second plates. The side plate may include a portion having a curvature radius less than that of at least a portion of the other one of the first and second plates.

In a similar example to this, optionally, the vacuum adiabatic body may include a heat transfer resistor provided to reduce a heat transfer amount between a first space provided in the vicinity of the first plate and a second space provided in the vicinity of the second plate. Examples of the heat transfer resistor are as follows. The present disclosure may be any one of the following examples or a combination of two or more examples. The heat transfer resistor may be provided to be integrated with at least one of the first or second plate. The heat transfer resistor may be provided to be integrated with any one of the first and second plates. The heat transfer resistor may be provided as any one of the first and second plates. The heat transfer resistor may be provided as a portion of any one of the first and second plates. The heat transfer resistor may be provided as a component separated from the other one of the first and second plates. In this case, optionally, the heat transfer resistor may be provided to be coupled or sealed to the other one of the first and second plates. The heat transfer resistor may include a portion having a degree of heat transfer resistance, which is greater than that of at least a portion of the other one of the first and second plates. The heat transfer resistor may include a portion having a thickness less than that of at least a portion of the other one of the first and second plates. The heat transfer resistor may include a portion having a curvature radius less than that of at least a portion of the other one of the first and second plates. The heat transfer resistor may include a portion having a curvature radius less than that of at least a portion of the other one of the first and second plates.

The contents described in FIGS. 1 to 11 may be applied to all or selectively applied to the embodiments described with reference to the drawings below.

FIG. 12 is a perspective view and a partial cross-sectional view illustrating a vacuum adiabatic body, in which FIG. 12(*a*) is a vacuum adiabatic body with left side down and right side up, FIG. 12(*b*) is a partially cutaway perspective view taken along line 1-1' of FIG. 12(*a*). FIG. 12(*c*) is a cross-sectional view taken along line 1-1'. In this figure, the foam member is illustrated in a state of being removed.

Referring to FIG. 12, the vacuum adiabatic body may be used for a door that opens and closes the accommodation space. The hinge may be installed on the first side of the vacuum adiabatic body. The first side may be provided thinner than the second side in order to avoid interference when the door is opened and closed. The additional adiabatic body 90 may be provided on the first side thinner than the second side. The first side and the second side may face each other. The first side may point to the A side in FIG. 12(*a*), and the second side may point to the B side in FIG. 12(*a*). The thickness of the sides of the C side and the D side connecting the A side and the B side may be gradually changed. Here, the C side may be the upper third side of the vacuum adiabatic body, and the D side may be the lower fourth side of the vacuum adiabatic body.

The description of the sides may be similarly applicable to at least one of the first plate 10, the second plate 20, the side plate 15, the additional adiabatic body 90, and the gasket 80. For example, the first and second plates may be provided in a rectangular shape. For example, the side plate may have four sides in a rectangular shape.

In one or more embodiments, the pipe 40 may be provided where the vacuum space 50 and the additional adiabatic body 90 contact each other. The first end of the pipe 40 may be placed on the vacuum space 50, and the second end of the pipe 40 may be placed on the additional adiabatic body 90. The pipe 40 may protrude into the additional adiabatic body 90. The other end of the pipe 40 does not protrude into the accommodation space, so that waste of the accommodation space can be prevented. The foam adiabatic material is an adiabatic material that is solidified after the foaming liquid is injected into the periphery of the vacuum adiabatic body and expands. The foaming liquid may be exemplified by polyurethane. The foam adiabatic material may generate a high pressure during the expansion process. The foam adiabatic material may allow the foam adiabatic material to penetrate into a narrow space of the periphery. The pipe 40 may not cross the outer boundary of the additional adiabatic body 90. The pipe 40 may be embedded in the additional adiabatic body 90 and the vacuum space 50. Examples of the aforementioned pipe may be ports such as exhaustion ports and getter ports.

Optionally, the height of the pipe 40 may be secured at least twice the diameter of the pipe 40. After exhaustion through the pipe 40 is completed, the pipe can be pinched off. Compression deformation may propagate during the pinch-off. It is possible to prevent the propagating deformation from deforming and breaking the fastening portion between the pipe 40 and the plate. The pipe 40, among the four corners 211 of the vacuum adiabatic body, may be placed on a corner 211 opposite to the upper hinge. The pipe 40 may be placed on the vacuum adiabatic body to prevent damage to the pipe 40. Examples of the aforementioned pipe may be ports such as exhaustion ports and getter ports.

Optionally, the foaming liquid may be injected downward from the top of the vacuum adiabatic body in order to use gravity. The vacuum adiabatic body may first be filled with a foaming liquid in the lower portion. When the foaming liquid is filled, a phenomenon in which the foaming liquid is concentrated downward in the direction of gravity may occur. The expansion force of the foaming liquid is greater in the lower part than in the upper part of the vacuum adiabatic body. The foaming liquid placed on the lower part of the vacuum adiabatic body has a large expansive force, firstly, due to the pressure of the foaming liquid on the upper portion, and secondly, due to the limitation of the foaming space due to the foaming liquid solidified in the upper portion. In order to reduce the influence of the expansion force of the foaming liquid on the pipe 40, the pipe 40 may be provided above the vacuum adiabatic body. In order to minimize the influence of the expansion force of the foaming liquid on the pipe 40, the pipe 40 may be provided in the first portion 101 of the first plate on the upper side of the vacuum adiabatic body. When ductile copper is used as the material of the pipe 40, the pipe 40 may be directly deformed. Examples of the aforementioned pipe may be ports such as exhaustion ports and getter ports.

Optionally, in order to reduce the influence of the local difference in the expansion force of the foaming liquid on the pipe 40, the pipe 40 may be provided above the vacuum adiabatic body. The pipe 40 may be provided in the first portion 101 of the first plate on the upper side of the vacuum adiabatic body. The pipe 40 may be spaced apart from the side plate 15 of the vacuum adiabatic body by a predetermined distance W1. Since the foaming liquid solidifies multiple times, the expansion force of the foaming liquid may be locally different. For example, the expansion force of the foam liquid on the right side of the pipe 40 may be greater than the expansion force of the foam liquid on the left side of the pipe 40. In this case, the pipe 40 may be damaged. The breakage of the pipe 40 may include at least one of deformation of a fastening portion between the pipe 40 and the first plate 10 and expansion breakage of a seal of the pipe 40. Examples of the aforementioned pipe may be ports such as exhaustion ports and getter ports.

Optionally, the insulation thickness of the portion on which the hinge is placed in the vacuum adiabatic body may be thinner than the opposite portion. Since the pipe 40 is placed on the opposite portion of the hinge of the vacuum adiabatic body, it is possible to reduce adiabatic loss. In the vacuum adiabatic body, the opposite portion of the hinge may refer to a portion opposite to the portion on which the hinge is installed. Examples of the aforementioned pipe may be ports such as exhaustion ports and getter ports.

Optionally, the pipe 40 may have a long portion protruding into the additional adiabatic body 90. The pipe 40 may provide a heat conduction path of heat passing therethrough. The pipe 40 provides a place in which the pipe rests by excluding the foaming liquid that makes up the additional adiabatic body 90. The pipe 40 may cause adiabatic loss of the vacuum adiabatic body. In order to reduce the adiabatic loss due to the pipe 40, the pipe 40 may be placed on the opposite side of the hinge of the vacuum adiabatic body having a relatively thick additional adiabatic body 90. The pipe 40 may be provided in the first portion 101 of the first plate on the portion opposite the hinge of the vacuum adiabatic body. Examples of the aforementioned pipe may be ports such as exhaustion ports and getter ports.

FIG. 13 is a partially cutaway perspective view and a cross-sectional view illustrating a cross section taken along line 2-2' of FIG. 12(*a*), (a) is a partially cutaway perspective view, and (b) is a cross-sectional view.

Referring to FIG. 13, the foaming liquid is injected through the foaming liquid injection port 470. The foaming liquid injection port 470 may not be vertically aligned with the pipe 40. The pipe 40 can avoid the pass path of the foaming liquid. The foaming liquid injected through the foaming liquid injection port may go down to the lower end of the vacuum adiabatic body without being caught in the pipe 40. Examples of the aforementioned pipe may be ports such as exhaustion ports and getter ports.

Preferably, the distance W1 between the pipe 40 and the side plate 15 is smaller than the distance W2 between the pipe 40 and the upper cover 112. The upper cover 112 may be placed on the edge of the third side. A lower cover 113 may be placed on a fourth side of the vacuum adiabatic body facing the upper cover 112. Examples of the aforementioned pipe may be ports such as exhaustion ports and getter ports.

FIGS. 14 to 16 are views related to a cross-section taken along line 3-3' of FIG. 12(*a*), in which FIG. 14 is a cross-sectional view taken along line 3-3' of FIG. 12(*a*), FIG. 15 is an enlarged cross-sectional view of part Z in FIG. 14, and FIG. 16 is a partially cutaway perspective view.

Referring to FIGS. 14 to 16, the thickness of the vacuum adiabatic body at the second side may be thicker than the thickness at the first side. The thickness of the additional adiabatic body 90 at the second side may be thicker than the thickness at the first side. Here, the thickness of the vacuum adiabatic body may mean a height between the first and second plates 10 and 20. The height of the vacuum space 50 may be the same at the first side and the second side.

Optionally, in the second side, the distance W3 from the third portion 203 of the second plate to the pipe 40 may be smaller than the distance W2 between the pipe 40 and the upper cover 112. Accordingly, it is possible to further reduce the adiabatic loss leaking upward of the pipe 40. In the second side, a virtual expansion line (X direction) of the second portion 152 of the side plate may pass through the pipe 40. Accordingly, it is possible to reduce the adiabatic loss leaking from the pipe 40 toward the second side of the vacuum adiabatic body. The third portion 203 of the second plate may be placed on an edge of at least one of the first side and the second side. Examples of the aforementioned pipe may be ports such as exhaustion ports and getter ports.

Optionally, a flange 42 may be provided on the first plate 10 for fastening the pipe 40 and the first plate 10. The flange 42 may extend inward of the vacuum space 50. In this case, it is easy to insert the pipe 40 into the flange 42. In this case, even in a state in which the first plate 10 and the second plate 20 are fastened, the pipe 40 can be easily fastened to the flange 42. The flange 42 may extend outwardly of the vacuum space 50. Interference between the flange 42 and components placed inside the vacuum space 50 can be prevented. The flange 42 may overlap the first space in the first portion 101 of the first plate. In this case, the adiabatic loss of the additional adiabatic body 90 can be reduced. Here, the overlapping may mean being aligned in the height direction of the vacuum space 50. Examples of the aforementioned pipe may be ports such as exhaustion ports and getter ports.

An embodiment according to the location and the shape of the flange 42 is presented.

Figure 17:
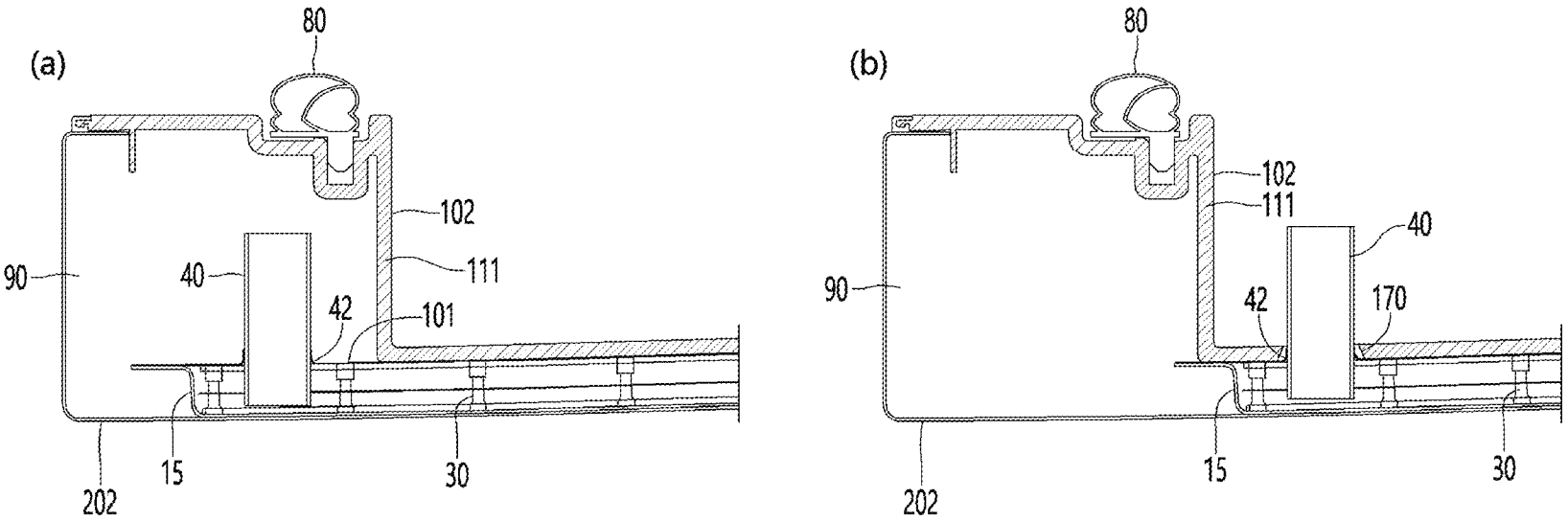
FIGS. 17 and 18 are views illustrating an embodiment of the flange and are views for explaining an embodiment in which the expansion direction of the flange and the position of the flange are different.
Figure 18:
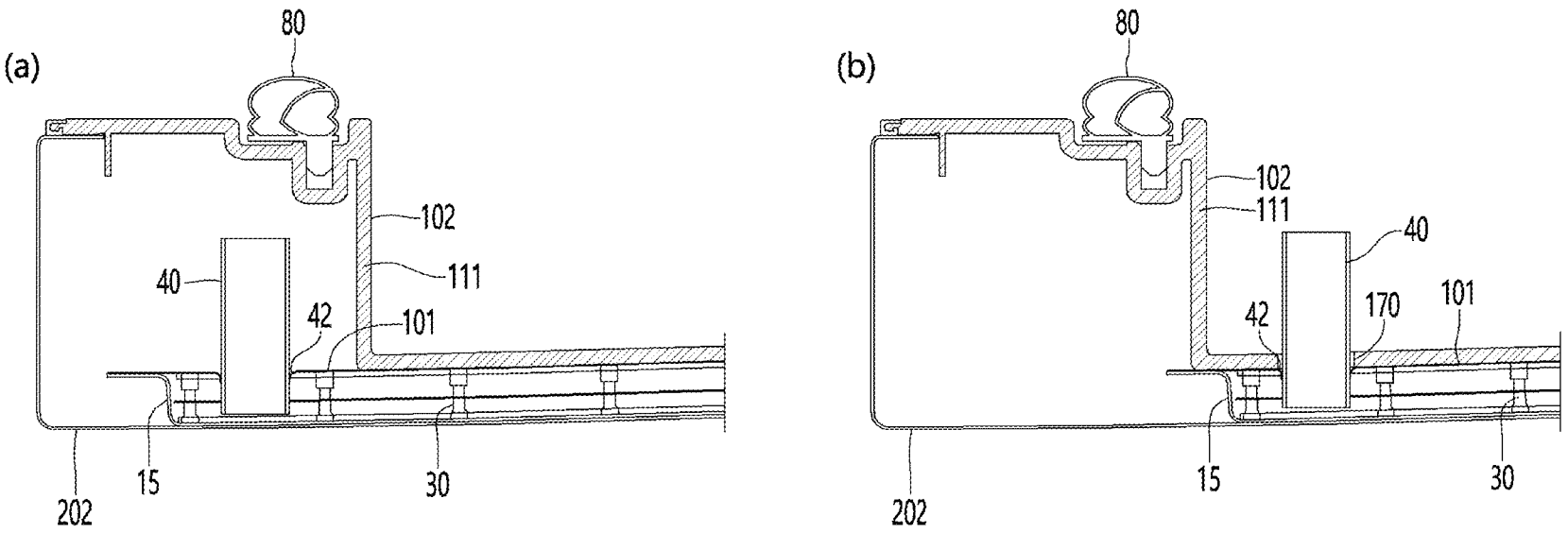

FIGS. 17 and 18 are views illustrating an embodiment of the flange and are views for explaining an embodiment in which the expansion direction of the flange and the position of the flange are different.

FIG. 17(*a*) and FIG. 17(*b*) illustrate a case in which the flange 42 extends outwardly of the vacuum space 50. FIG. 18(*a*) and FIG. 18(*b*) illustrate a case in which the flange 42 extends inward of the vacuum space 50. FIG. 17(*a*) and FIG. 18(*a*) illustrate a case in which the flange 42 overlaps the additional adiabatic body 90 in the first portion 101 of the first plate. FIG. 17(*b*) and FIG. 18(*b*) illustrate a case in which the flange 42 overlaps the first space in the first portion 101 of the first plate.

According to the first embodiment of FIG. 17(*a*), the accommodation space can be secured widely. It is possible to prevent the flange 42 from interfering with at least one of the support 30 and the heat transfer resistor. According to the present embodiment, at least one of the support 30 and the heat transfer resistor may be installed in various ways. According to the present embodiment, at least one of the support 30 and the heat transfer resistor may be installed in plurality.

According to the second embodiment of FIG. 17(*b*), it is possible to reduce the adiabatic loss of the additional adiabatic body 90 caused by the pipe 40. It is possible to prevent the flange 42 from interfering with at least one of the support 30 and the heat transfer resistor. According to the present embodiment, at least one of the support 30 and the heat transfer resistor may be installed in various ways. According to the present embodiment, at least one of the support 30 and the heat transfer resistor may be installed in plurality. In the present embodiment, a through-hole 170 through which the pipe passes may be provided in the inner panel 111. The diameter of the through-hole 170 of the inner panel 111 may be larger than the outer surface of the flange 42. The flange 42 and the through-hole may be spaced apart from each other. When the pipe 40 is circular, the outer diameter of the pipe 40 may be smaller than the inner diameter of the through-hole 170. The through-hole of the inner panel 111 may be provided to be inclined or rounded to correspond to the shape of the flange 42. Examples of the aforementioned pipe may be ports such as exhaustion ports and getter ports.

According to the third embodiment of FIG. 18(*a*), it is possible to secure the accommodation space widely. The pipe 40 can be conveniently inserted along the flange 42.

According to the fourth embodiment of FIG. 18(*b*), it is possible to reduce the adiabatic loss of the additional adiabatic body 90 caused by the pipe 40. The pipe 40 can be conveniently inserted along the flange 42. In the present embodiment, the pipe 40 may penetrate the first portion 101 of the first plate as a whole. In the present embodiment, the pipe 40 may pass through the inner panel 111. A through-hole 170 may be provided in the inner panel 111. Examples of the aforementioned pipe may be ports such as exhaustion ports and getter ports.

In the present disclosure, the vacuum adiabatic body may include a first plate 10 having a first temperature, a second plate 20 having a second temperature, and a seal which seals the first plate and the second plate to provide the vacuum space 50. Optionally, the vacuum adiabatic body may be manufactured by a vacuum adiabatic body component preparation step in which the first plate and the second plate are prepared in advance, a vacuum adiabatic body component assembly step in which the prepared first plate and the second plate are assembled, and a vacuum adiabatic body vacuum exhaustion step in which the gas in the space formed between the first plate and the second plate is evacuated after the component assembly step. Optionally, before the vacuum adiabatic body vacuum exhaustion step, the vacuum adiabatic body may be manufactured by a vacuum adiabatic body component sealing step in which the space between the first plate and the second plate is sealed. Optionally, after the vacuum adiabatic body vacuum exhaustion step, a device assembly step in which the vacuum adiabatic body and the components constituting the device are coupled may be performed.

Optionally, the vacuum adiabatic body may include a component connected to the additional adiabatic body 90. Examples related to the above components are as follows. The present disclosure may be any one of the following examples or an example in which two or more examples are combined. The component may include a latch 81. The component may include a first portion and a second portion provided in a state of being connected to the first portion. The first portion may include a portion having a lower heat transfer resistance than the second portion. The first portion may be provided to be movable. The component may be provided in the central portion of the additional adiabatic body. The component may be accommodated in a groove formed in the additional adiabatic body. A length of the groove in the Y-axis direction may be greater than ½ of a height of the additional adiabatic body in the Y-axis direction.

Optionally, a second additional adiabatic body provided separately from the additional adiabatic body 90 may be included. Examples of the second additional adiabatic body are as follows. The present disclosure may be any one of the following examples, or an example in which two or more examples are combined. The second additional adiabatic body may have a smaller height than the additional adiabatic body in the Y-axis direction. The second additional adiabatic body may have a smaller volume than the additional adiabatic body. The second additional adiabatic body 90 may include a portion to which a separate component distinct from the component 81 is connected. The separate component may include a hinge. The separate component may be provided so as not to overlap a portion of the side plate in the height direction of the vacuum space. The portion may include a portion extending in the height direction of the vacuum space. The portion may be provided to be located inside the additional adiabatic body. The portion may be provided to be spaced apart from the component by a predetermined distance in the longitudinal direction of the vacuum space. The predetermined distance may be greater than the height of the vacuum space. The portion may be provided to overlap the component in the longitudinal direction of the vacuum space. The component may be provided so as not to overlap a portion of the support 30 in the height direction of the vacuum space. The portion may include a bar 31. The portion may include the bar and an additional bar adjacent to the bar and spaced apart from the bar by a predetermined distance. The portion may be provided to be spaced apart from the component by a predetermined distance in the longitudinal direction of the vacuum space. The predetermined distance may be greater than the height of the vacuum space. The portion may be provided to overlap the component in the longitudinal direction of the vacuum space.

Figure 19:
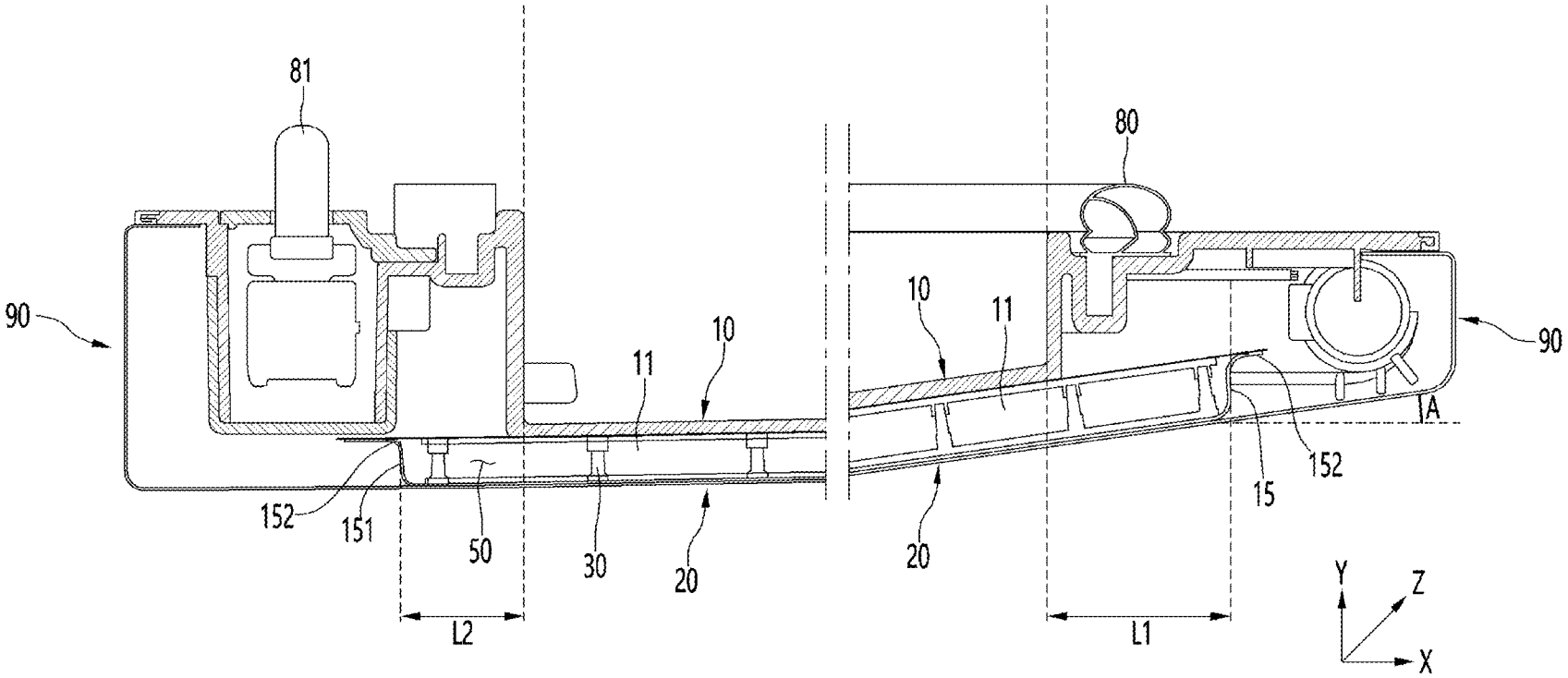
FIG. 19 is a cross-sectional view of a periphery of the vacuum adiabatic body.

FIG. 19 is a view comparing the peripheries of both sides of the vacuum adiabatic body according to the embodiment and is a view comparing a cross-sectional view of a portion of the second side of the vacuum adiabatic body and a cross-sectional view of a portion of the first side of the vacuum adiabatic body.

Referring to FIG. 19, a portion of the second side of the vacuum adiabatic body and a portion of the first side of the vacuum adiabatic body are different from each other. The additional adiabatic body 90 placed the inner portion which can be defined as the inside of the first plate 10, the second plate 20, and the side plate 15, is different from each other on the portions of the first and second sides. The additional adiabatic body 90 may use various insulating materials such as foamed insulating material and premolded resin.

The heat insulation area (XY plane) of the additional adiabatic body 90 is larger at the portion of the second side than at the portion of the first side. The insulation thickness of the vacuum space 50 of the additional adiabatic body 90 in the height direction (Y direction) is greater at the portion of the second side than at the portion of the first side. Accordingly, more additional adiabatic body 90 may insulate the portion of the second side, and the adiabatic performance of the portion of the second side in which the components such as the latch 81 is placed may be further reinforced. The adiabatic thickness of the vacuum space 50 of the additional adiabatic body 90 in the longitudinal direction (X direction) is greater at the portion of the first side than at the portion of the second side. Accordingly, it is possible to reduce heat loss that leaks to the edge of the portion of the second side having a smaller adiabatic area than the portion of the first side.

The adiabatic thickness change rate in the height direction (Y direction) of the vacuum space 50 of the additional adiabatic body 90 is greater at the portion of the first side than at the portion of the second side. Accordingly, it is possible to minimize the interference between the components according to the opening and closing of the door on the portion on which the hinge is placed while reducing the adiabatic loss. Accordingly, the inclination angle A of the second portion of the second plate 20 may be greater at the portion of the first side. The second part 202 of the second plate may cause interference with an external object, but since the inclination angle A of the second part 202 of the second plate is large, the interference between the components can be prevented.

The additional adiabatic body 90 may use a foam adiabatic material. The foam adiabatic material may be subjected to a process of solidifying after the foaming liquid is injected. The foaming liquid is a fluid and is affected by the hydraulic diameter of the injected space. The hydraulic diameter may be proportional to the adiabatic area and inversely proportional to the length of a curve surrounding the adiabatic area. The hydraulic diameter is larger at the portion of the second side than at the portion of the first side. The foaming liquid may flow more smoothly at the portion of the second side than at the portion of the first side. The foaming liquid may be more filled at the portion of the second side than at the portion of the first side. When a lot of foaming liquid is injected, a larger foaming pressure can be applied.

Since the hydraulic diameter is larger at the portion of the second side than at the portion of the first side, the foaming liquid at the portion of the first side does not flow smoothly. In order to improve the fluidity of the foaming liquid, the second portion 152 of the side plate at the portion of the first side does not extend to the component. In order to improve the fluidity of the foaming liquid, the second portion 152 of the side plate at the portion of the first side may maintain a predetermined distance from the component in the longitudinal direction (X direction) of the vacuum space 50. In order to improve the fluidity of the foaming liquid, the second portion 152 of the side plate at the portion of the first side may not overlap the component in the height direction (Y direction) of the vacuum space 50. Here, the component may include a hinge.

Although the fluidity of the foaming liquid is not bad at the portion of the second side, the position of each member may be shifted or the member may be deformed due to a high foaming pressure. The second portion 152 of the side plate at the portion of the second side may extend beyond the component in the longitudinal direction (X direction) of the vacuum space 50. Accordingly, the second portion 152 of the side plate and the part interact to maintain a positional relationship between the members according to the design. The second portion 152 of the side plate at the portion of the second side may overlap the component in the height direction (Y direction) of the vacuum space 50. Accordingly, the second portion 152 of the side plate and the component interact to maintain a positional relationship between the members according to the design. Here, the component may include a latch 81. In addition, several components may be in contact with each other, support each other or be fixed to each other. The movable member such as the latch 81 exposed to an external impact can maintain the original design position thereof by the interconnection structure.

The vacuum space 50 at the portion of the first side may further extend in the edge direction compared to the vacuum space 50 at the portion of the second side. Starting from the second portion 102 of the first plate, in the edge direction, With respect to the length of the vacuum space 50, the length L1 at the portion of the first side may be longer than the length L2 at the portion of the second side. With respect to the length of the vacuum space 50 extending beyond the first space, which is a low-temperature space, the length L1 at the portion of the first side may be longer than the length L2 at the portion of the second side.

The portion of the first side is a portion on which the hinge is placed, and the insulating wall at the portion of the first side is thinner than the insulating wall at the portion of the second side. The portion of the first side is a portion on which a hinge is placed, and is a portion on which a heavy load is applied since a hinge supporting a load is placed thereon. The first vacuum adiabatic body 11 including the first plate 10, the side plate 15, the support 30, or the like is a component having high-strength. As the component of the first vacuum adiabatic body 11 further extends at the portion of the first side, the strength at the portion of the first side may be reinforced. Damage or deformation of each member at the portion of the first side can be prevented by the reinforced strength.

The vacuum space 50 may have a higher adiabatic performance than the additional adiabatic body 90. The vacuum space 50 may compensate for insufficient adiabatic performance due to the thin foam adiabatic material at the portion of the first side. The vacuum space 50 may be placed over an area where the portion of the first side is wider than the portion of the second side. Accordingly, it is possible to reinforce the insufficient adiabatic performance at the portion of the first side.

Figure 20:
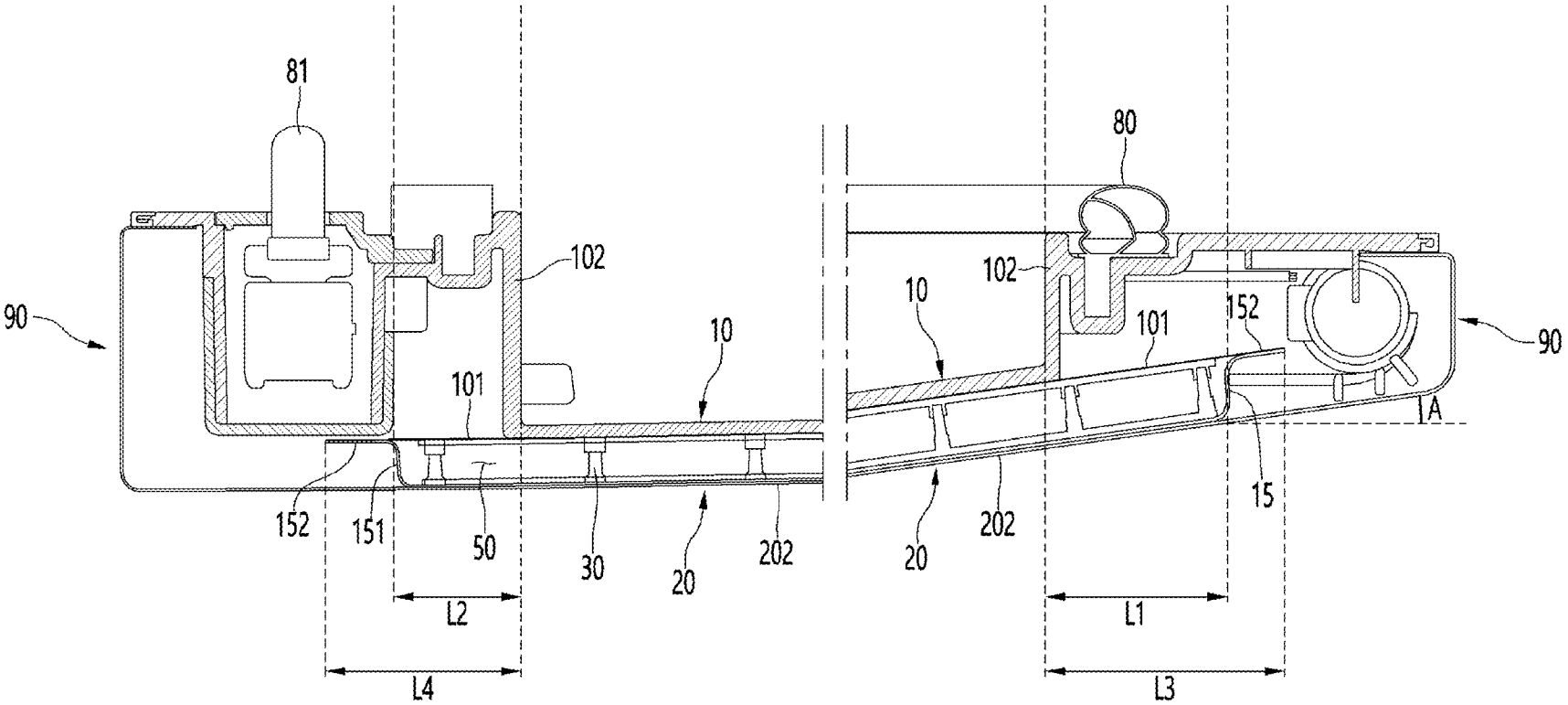
FIG. 20 is a view comparing the peripheries of both sides of the vacuum adiabatic body according to another embodiment.

FIG. 20 is a view comparing the peripheries of both sides of the vacuum adiabatic body according to another embodiment. A portion different from the description of FIG. 19 will be mainly described.

A length L1 of the first portion 101 of the first plate placed inside the additional adiabatic body at the portion of the first side may be longer than the length L2 at the portion of the second side. With respect to the length of the first portion 101 of the first plate starting from the second portion 102 of the first plate toward the edge, the length L1 at the portion of the first side may be longer than the length L2 at the portion of the second side.

The volume in which the additional adiabatic body is placed may be smaller at the portion of the first side at the portion of the second side. The hydraulic diameter may be smaller at the portion of the first side than at the portion of the second side. The expansion pressure of the foaming liquid may be greater at the portion of the second side than at the portion of the first side. If the expansion pressure is greater, the first plate 10 may be damaged. Since the first plate 10 is a thin member, it may be more vulnerable to the expansion pressure. In order to prevent damage to the first plate 10, the length of the first portion 101 of the first plate placed inside the additional adiabatic body may be greater at the portion of the first side than at the portion of the second side. Here, the length of the first portion 101 of the first plate placed inside the additional adiabatic body may be exposed to the foaming member, that is, to the foaming liquid having an expansion pressure. The longer the length of the first portion 101 of the first plate placed inside the additional adiabatic body, the greater the damping force may be. A longer length of the first portion 101 of the first plate placed inside the additional adiabatic body may cause more and greater deformation. Accordingly, a greater damping force can be exerted. The first plate 10 of a larger area may be deformed in response to the foaming pressure.

The portion of the first side may have a greater number of bars aligned with the additional adiabatic body than the portion of the second side. The number of bars aligned with the additional adiabatic body on the portion of the first side may be at least two. According to this configuration, it is possible to prevent the damping force from becoming excessively large. This is because, if the first plate 10 is changed excessively, the thin first plate 10 may be damaged.

An edge of the second portion 152 of the side plate may further extend in an edge direction at the portion of the first side than the at the portion of the second side. With respect to the length from the second portion 102 of the first plate to the edge of the second portion 152 of the side plate toward the edge, the length L3 at the portion of the first side may be longer than the length L4 at the portion of the second side. With respect to the length to the edge of the second portion 152 of the side plate extending beyond the first space, which is a low-temperature space, the length L3 at the portion of the first side may be longer than the length L4 at the portion of the second side.

The insulation may be weaker at the portion of the first side than at the portion of the second side. The volume of the additional adiabatic body may be smaller at the portion of the first side than at the portion of the second side. The influence of the first space, which is a low-temperature space, may have a greater effect at the portion of the first side. For example, cold air intermittently supplied from the first space may be conducted along the first plate 10 to apply a thermal impact to the seal of the second portion 152 of the side plate. The seal may be vulnerable to thermal impact because the heated member is deformed. The distance from the second portion 102 of the first plate to the second portion 152 of the side plate may be a path of thermal impact conducted along the first plate 10. The distance from the second portion 102 of the first plate to the second portion 152 of the side plate may act as a conductive resistance sheet. This is because the first plate 10 is a thin plate of 0.1 mm. In an embodiment, the distance from the second portion 102 of the first plate to the second portion 152 of the side plate is longer at the portion of the first side than at the portion of the second side. Accordingly, by reinforcing the weak insulating performance at the portion of the first side, it is possible to reduce thermal impact received by the seal.

The volume in which the additional adiabatic body is placed may be smaller at the portion of the first side than at the portion of the second side. The hydraulic diameter may be smaller at the portion of the first side than at the portion of the second side. In the portion of the second side, the expansion pressure of the foaming liquid may be greater. If the expansion pressure is greater, the first plate 10 may be damaged. Since the first plate 10 is a thin member, the first plate 10 may be more vulnerable to the expansion pressure. In order to prevent damage to the first plate 10, the distance from the second portion 102 of the first plate to the edge of the second portion 152 of the side plate may be larger at the portion of the first side than at the portion of the second side. Accordingly, a greater damping force can be exerted. The first plate 10 of a larger area may be deformed in response to the foaming pressure.

INDUSTRIAL APPLICABILITY

According to the present disclosure, it is possible to provide a vacuum adiabatic body that can be applied to real life.

The invention claimed is:

1. An adiabatic door, comprising:

a first plate;

a second plate spaced apart from the first plate in a first direction to form a vacuum space between the first plate and the second plate;

an insulated foam body configured to insulate a periphery of the first plate and the second plate; and a hinge configured to be disposed next to a first side of the first plate and the second plate, and configured to provide rotation of the adiabatic door, wherein a length L1 of the insulated foam body at a first indent toward an edge of the first side is different from a length L2 at a second indent toward an edge of a second side in an edge direction of the insulated foam body.

2. The adiabatic door of claim 1, wherein the length L1 at a portion of the first side is longer than the length L2 at a portion of a second side of the first plate and the second plate in the edge direction of the insulated foam body.

3. The adiabatic door of claim 1, wherein, with respect to a length of the vacuum space, a length at the first side is longer than a length at a second side of the first plate and the second plate.

4. The adiabatic door of claim 1, wherein a foam member is accommodated in the insulated foam body.

5. The adiabatic door of claim 4, wherein a thickness of the insulated foam body at the first side is smaller than a thickness of the insulated foam body at a second side of the first plate and the second plate.

6. The adiabatic door of claim 1, wherein the side plate includes:

a first portion configured to define a side of the vacuum space; and a second portion that extends from the first portion in a longitudinal direction of the vacuum space.

7. The adiabatic door of claim 1, wherein a volume of the insulated foam body at the first side is narrower than a volume of the insulated foam body at a second side of the first plate and the second plate.

8. The adiabatic door of claim 1, wherein a foaming pressure of the foaming liquid at the first side is less than a foaming pressure of the foaming liquid at a second side of the first plate and the second plate.

9. The adiabatic door of claim 1, wherein a total number of bars aligned with the insulated foam body at the first side is greater than a total number of bars aligned with the insulated foam body at a second side of the first plate and the second plate.

10. The adiabatic door of claim 1, wherein a total number of bars aligned with the insulated foam body at the first side is at least two.

11. The adiabatic door of claim 1, wherein an edge of the side plate extends further in the edge direction at the first side than an edge of the side plate that extends in the edge direction at a second side of the first plate and the second plate.

12. An appliance comprising the adiabatic door of claim 1.

13. An adiabatic door, comprising:

a first plate;

a second plate spaced apart from the first plate in a first direction to form a vacuum space between the first plate and the second plate;

a side plate configured to define a side of the vacuum space;

an insulated foam body to insulate a periphery of the first plate and the second plate; and a hinge disposed adjacent to a first side of the first plate and the second plate, and configured to provide rotation of the adiabatic door, wherein the vacuum space extends a length L1 from a first notch of the first plate towards a first edge of the insulated foam body, wherein the vacuum space extends a length L2 from a second notch of the first plate towards a second edge of the insulated foam body, and wherein the length L1 is greater than the length L2.

14. The adiabatic door of claim 13, wherein the vacuum space extends further in the edge direction of the insulated foam body at the first side than at a second side of the first plate and the second plate, and wherein the side plate and the second plate are one body.

15. The adiabatic door of claim 14, wherein a first portion of the side plate is closer to the edge of the adiabatic door at the first side than at a second side of the first plate and the second plate.

16. An appliance comprising the adiabatic door of claim 13.

* * * * *